US009325073B2

(12) United States Patent
Waters

(10) Patent No.: US 9,325,073 B2
(45) Date of Patent: Apr. 26, 2016

(54) APPARATUS FOR ASSEMBLING DIFFERENT CATEGORIES OF MULTI-ELEMENT ASSEMBLIES TO PREDETERMINED TOLERANCES AND ALIGNMENTS USING A RECONFIGURABLE ASSEMBLING AND ALIGNMENT APPARATUS

(71) Applicant: The United States of America as represented by the Secretary of the Navy, Washington, DC (US)

(72) Inventor: Jeffrey M. Waters, Solsberry, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 211 days.

(21) Appl. No.: 14/250,534

(22) Filed: Apr. 11, 2014

(65) Prior Publication Data

US 2015/0194732 A1 Jul. 9, 2015

Related U.S. Application Data

(60) Provisional application No. 61/925,165, filed on Jan. 8, 2014.

(51) Int. Cl.

| | |
|---|---|
| ***B25B 27/14*** | (2006.01) |
| ***H01Q 13/02*** | (2006.01) |
| ***H01Q 1/12*** | (2006.01) |
| ***H01Q 21/00*** | (2006.01) |
| ***H01Q 21/06*** | (2006.01) |
| ***B25B 5/12*** | (2006.01) |
| ***B25B 11/02*** | (2006.01) |

(52) U.S. Cl.

CPC ..... *H01Q 13/0283* (2013.01); *B25B 5/12* (2013.01); *B25B 11/02* (2013.01); *H01Q 1/1207* (2013.01); *H01Q 21/0087* (2013.01); *H01Q 21/064* (2013.01); *Y10T 29/4902* (2015.01); *Y10T 29/49016* (2015.01); *Y10T 29/49899* (2015.01); *Y10T 29/53961* (2015.01)

(58) Field of Classification Search

CPC ..... Y10T 29/49895; Y10T 29/49998; Y10T 29/49826; Y10T 29/49016; Y10T 408/563

USPC ..... 29/281.1, 243.5, 281.3, 281.4, 281.5, 29/281.6, 428, 466, 600, 602.1

See application file for complete search history.

(56) References Cited

U.S. PATENT DOCUMENTS

| | | | | |
|---|---|---|---|---|
| 7,984,742 | B2 * | 7/2011 | Shackelford | B25H 1/10 156/580 |
| 2011/0005512 | A1 * | 1/2011 | Ruesswick | F24J 2/5232 126/600 |

*Primary Examiner* — Thiem Phan

(74) *Attorney, Agent, or Firm* — Christopher A. Monsey

(57) ABSTRACT

Systems and methods for assembling different multi-element items with different specifications using a reconfigurable apparatus are provided. One embodiment includes a base plate, a back plate coupled to the base plate in a predetermined angle relationship. The exemplary back plate comprises a plurality of alignment pins adapted to engage with alignment locations of multiple element assembly items. The exemplary base plate and alignment mounting structures couple to end cap parts disposed on opposing ends of the multiple element assembly items holding the items together. A clamping mechanism maintains/releases pressure on the multiple element assembly items against the back plate. The back plate holds alignment pins in a first back plate location in a first orientation for one type of multiple element assembly items and hold the alignment pins in a second location when the back plate is in a second orientation for a different type of multiple element assembly items.

4 Claims, 27 Drawing Sheets

Step 300 - position back plate in predetermined configuration, aligning proper base plate mounting holes with corresponding back plate mounting holes, so that back plate aperture and alignment pins are in the predetermined position to align with desired assembly elements.

Step 301 - obtain one or more reference measurements.
* Measure horn assembly mounting hole distance using VERSA GAUGE and record the distance measurement.

Step 302 - disassemble for blast coating.
* Lay assembly flat on a reconfigurable multi-element apparatuses base with end cap mounting holes down and remove all-thread rods connecting end caps to element stack. Remove end caps while supporting element stack alignment apparatus for removal of remaining rods. Next, remove remaining rods and carefully dis-assemble elements from each other afterwards removing all connectors and shims from each element and reinstalling connector mounting screws into each element.

Step 303 - inspect all components.
* User should inspect all elements for damaged to mating surfaces, i.e., inspect element signal surfaces for voids in castings; inspect element roll pins for damage and perpendicular alignment to element.

Step 304 - reassemble element components.

Step 305 - install right side First Type Horn Assembly end cap (left looking at fixture) with two mounting bolts to base fixture using a framing square as a guide to ensure the end cap is perpendicular to back plate before applying torque to bolts.

Step 306 - install first element by aligning connector hole onto alignment pin making sure each element is seated against First Type Horn assembly end cap.

Step 307 - install next element by aligning connector hole to alignment pin and lock into previous element.

Step 308 - continue step 307 until all elements have been stacked together.

Step 309 - install element end plate to complete the element stack.

Fig. 17A

Step 310 - secure the element stack with ratchet strap to keep assembly together.

Step 311 - apply pressure to front of First Type Horn Stack Assembly using large ratchet strap/wood block, ensure each element is visually seated against the back plate of fixture.

Step 312 - begin installing all threaded rods and placing/inserting nuts on threaded rods.

* Using a feeler gauge on those elements that do not look seated to ensure that elements are within tolerance. Gently tap unseated elements with a rubber mallet as torque is applied to all threaded rods in element stack to ensure elements remain seated, as rods are tightened.

Step 313 - apply predetermined torque on installed rods.

Step 314 - refer to reference measurements, measure outside of element stack to check for a wedge, or out of parallel condition of elements, and compute needed shims to bring elements with in predetermined tolerances.

Step 315 - apply fine adjustments.

* Loosen pressure on element stack slightly to allow application of even amounts of said shims to each side.

Step 316 - tighten straps and apply predetermined final torque. Install threaded rods, nuts, shims and other hardware and torque to predetermined torque using a predetermined torque pattern trying to obtain even amounts of visible thread on all thread rods as it passes through end cap.

Step 317 - verify specification measurements and repeat above steps as required

* Ensure assembly meets predetermined dimensions. If the assembly does not meet predetermined dimensions repeat above steps and add or remove shims as needed.

Fig. 17B

Step 400 - postition back plate in predetermined configuration, aligning base plate mounting holes with corresponding back plate mounting holes, so that plate aperture and alignment pins are in the predetermined position to align with desired assembly elements.

Step 401 - obtain one or more reference measurements.

* Measure horn assembly mounting hole distance using VERSA GAUGE and record the distance measurement.

Step 402 - disassemble for blast coating.

* Lay assembly flat on horn assembly fixture base with end cap mounting holes down and remove all-thread rods connecting end caps to element stack. Remove end caps while supporting element stack on alignment apparatus for removal of remaining rods. Next, remove remaining rods and carefully disassemble elements from each other afterwards removing all connectors from each element and reinstalling connector mounting screws into each element.

Step 403 - inspect all components.

* A user should inspect all elements for damaged to mating surfaces, i.e., inspect element signal surfaces for voids in castings; inspect element roll pins for damage and perpendicular alignment to element.

Step 404 - reassemble element components.

* Install first element by aligning connector hole onto alignment pin making sure element is seated against back plate of fixture. It may become necessary to install several elements together, and place into position multiple elements at a time (e.g., 3-4 elements) on alignment. Ensure elements are perpendicular to back plate using a framing square as a reference.

Step 405 - continued above step until all elements have been stacked together.

Step 406 - install element end plate to complete stack.

Step 407 - secure element stack with ratchet strap and tighten to keep assembly together.

Step 408 - stabilize element stack by placing wooden arc abutting front of element stack with ratchet strap around back plate of fixture, and applying slight pressure with ratchet strap.

Fig. 18A

Step 409 - begin installing all treaded rods.

* using an alternating process of one rod in front and one rod in back until all rods are installed.
* with pressure applied to front of horn stack using ratchet strap, ensure each elements is visually seated against the back plate of fixture. Use a feeler gauge on those elements that do not look seated and gently tap unseated elements with a rubber mallet as torque is applied to all threaded rods of the element stack. It will be necessary to continually check that elements remain seated, and remain perpendicular to back plate as threaded rods are tightened. Stop the process and tap those elements that move out of seated position.

Step 410 - remove element stack from horn aseembly fixture and carefully install spacer boards and finger clamps, which engage to apertures in element stack, applying pressure to finger clamps by turning turn buckle.

Step 411 - remove all thread rods that are used for mounting end caps.

Step 412 - install end caps and apply final torque.

Step 413 - refer to reference measurement, (made prior to disassembly) and measure outside of element stack to check for a wedge, or out of parallel condition. Compute needed shims.

Step 414 - loosen finger clamps slightly to allow installation of even amounts of the shims to each side.

Step 415 - tighten clamps and repeat measurement, loosening, calculation and addition of required shims until predetermined alignment of said elements are achieved.

Step 416 - install rods and hardware and torque to predetermined torque using a predetermined pattern. Try to obtain even amounts of visible thread on all thread rods as it passes through end cap.

Step 417 - verify specification measurements and repeat above steps as required.

* ensure assembly meets predetermined dimensions. If the assembly does not meet predetermined dimensions repeat above steps and add or remove shims as appropriate.

Fig. 18B

Step 501 - position said back plate in a first orientation so as to align the base plate's mounting holes, so that the back plate's elongated aperture adapted to receive the plurality of alignment pins is in position to enable respective alignment and insertion of the pins into the connector holes in the first section of each of the pluratliy of first directional elements;

Step 502 - insert the plurality of alignment pins through the back plate elongated aperture;

Step 503 - install the first and second end cap with end caps mounting bolts to the base plate;

Step 504 - sequentially position and couple each of the plurality of first directional elements between the first and second end caps on the base plate by sequentially placing one side of the plurality of first directional elements on the base plate and the first section of the plurality of first directional elements on the base plate so as to bring the first section of each directional element in contact with the back plate and aligning the connector hole with a respective plurality of alignment pins such that each directional axis of each plurality of first directional elements are approximately parallel to each other and aligned in at least two reference planes;

Step 505 - install the end caps on either end of the plurality of directional element's stack;

Step 506 - insert the plurality of protrusions extending from the compression or clamping mechanism into at least some of the plurality of directional openings on opposing end sections of the stack of a plurlity of directional element stack;

Step 507 - apply compressive pressure to the element stack using the compression or clamping mechanism;

Fig. 19A

Step 508 - install the threaded rods into the rod passages and couple the first and second nuts on the threaded rods;

Step 509 - apply predetermined final torque on installed threaded rods;

Step 510 - make at least one alignment measurement of the stack and the plurality of the first directional elements to determine if one or more out of alignment parametes exists associated with one or more directional axis of one or more of the plurality of first directional elements exists, wherein the one or more out of alignment parameters comprise an out of parallel dimension range parameter associated with the plurality of first directional elements;

Step 511 - if an out of parallel dimension range or parameter condition exists, determine size and number of shims to bring plurality of first directional elements into a predetermined alignment associated with the first directional axis of each of the first directional elements;

Step 512 - make adjustment of one or more of the first directional elements by loosening the nuts and the compressive or clamping structure's pressure on the first directional element stack sufficient to enable insertion of the shims into the first directional element stack so as to bring the stack into a predetermined alignment;

Step 513 - tighten the compression or clamping mechanism and the said first and second nuts on the threaded rods, using a predetermined torque pattern;

Step 514 - repeat making the alignment measurement step to determine if one or more out of alignment parameters exists and repeat steps following the making at least one alignment measurement step until the one or more alignment parameters are not found to exist.

Fig. 19B

APPARATUS FOR ASSEMBLING DIFFERENT CATEGORIES OF MULTI-ELEMENT ASSEMBLIES TO PREDETERMINED TOLERANCES AND ALIGNMENTS USING A RECONFIGURABLE ASSEMBLING AND ALIGNMENT APPARATUS

CROSS-REFERENCE TO RELATED APPLICATIONS

The present application claims priority to U.S. Provisional Patent Application Ser. No. 61/925,165, filed Jan. 8, 2014, entitled "APPARATUS AND PROCESS FOR MAINTAINING TOLERANCES OF RECONFIGURABLE MULTI-ELEMENT APPARATUSES USABLE FOR DIFFERENT ASSEMBLY PROCESSES," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 103,026) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to the field of assembly and adjustment of elements requiring high precision alignment. In particular, the invention includes an apparatus and method for aligning, sequencing, and assembling multiple elements requiring high precision alignment that is adaptable for use with different end items.

Construction and maintenance of complex assemblies which require disassembling and reassembling with small tolerances for fit and alignment has been a substantial challenge. A variety of equipment items, for example horn antennas, have required numerous rework activities, as initial assembly results do not meet print specifications. For example, costs associated with existing methods and equipment resulted in multiple rework activities, i.e., tear down, realignment, etc., exceeding funding allowances for overhaul and restoration. One existing approach called for assembly of elements of a multi-element horn antenna on a flat controlled surface that provided a planar datum reference for element body to element body alignment but did not manage or control critical elements of each body, e.g., machined connector hole or connector hole surface. Existing processes and equipment were particularly unsuitable due to use of cast elements which had some degree of variation in body elements which called for shimming or inter-element alignment adjustment after an initial assembly. A need existed for a multi-datum alignment system which permitted an initial assembly, measurement/evaluation of multiple alignment specifications, then a small increment disassembly which permitted small or very small alignment adjustments to be made while permitting other elements of the multi-element assembly to remain fixed in relation to each other. A need also existed to create a process and apparatus which allowed for assembly, measurement/adjustment, and reassembly of the multi-element assembly with final configuration elements such as end caps or other structures which hold the multi-assembly together in an end use configuration. Another need was to create an apparatus which was operable with more than one multi-element assembly so that support equipment requirements were reduced and reconfiguration time and effort were reduced to a minimum.

According to a further illustrative embodiment of the present disclosure, a base plate is coupled with a back plate that is configured with multiple alignment pins adapted to engage with alignment locations of multiple element assembly items, e.g., elements, such that the elements are held in a predetermined orientation with respect to a back plate and base plate. The base plate is further configured to couple to parts of the multiple elements, which are used in end applications, to hold the items together in an end application use. An exemplary apparatus further includes an adjustable compression or clamping mechanism which maintains/releases pressure on the multiple elements against the back plate so as to permit measurements of tolerances of the elements and re-alignment of the elements with respect to each other. The back plate in this embodiment is adapted to hold the alignment pins in a first location when the back plate is in a first orientation for one type of multiple elements, and hold the alignment pins in a second location when the back plate is in a second orientation for a different type of elements. Different types of adjustable compression or clamping mechanisms can be used including a strap run laterally across the elements when positioned in an element stack and around a back side of the back plate opposite of a side facing the element stack, as well as an expansion mechanism, such as a scissor jack having a screw actuator that leverages against a leverage point on the base plate on one side and against a side of the element stack on a side of the element stack opposing an element stack side in contact with the back plate. An embodiment of the invention can also include an adjustable tensioner, such as a turnbuckle, that couples between two finger brackets which insert protrusions of the finger brackets into apertures created by respective multiple elements in a final configuration on opposing ends of the element stack.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which:

FIGS. 17A and 17B show an exemplary assembly process for maintaining tolerances of reconfigurable multi-element apparatuses for a first type of directional elements such as a first type of directional antennas e.g., a first type horn antenna assembly;

FIGS. 18A and 18B show an exemplary assembly process for achieving tolerances of reconfigurable multi-element apparatuses for a second type of horn antenna assembly;

FIGS. 19A and 19B show an exemplary assembly process for assembling at least one of multiple categories of multi-element assemblies to predetermined tolerances and alignments using a reconfigurable assembling and alignment apparatus in accordance with an embodiment of the invention;

DETAILED DESCRIPTION OF THE DRAWINGS

Figure 1:
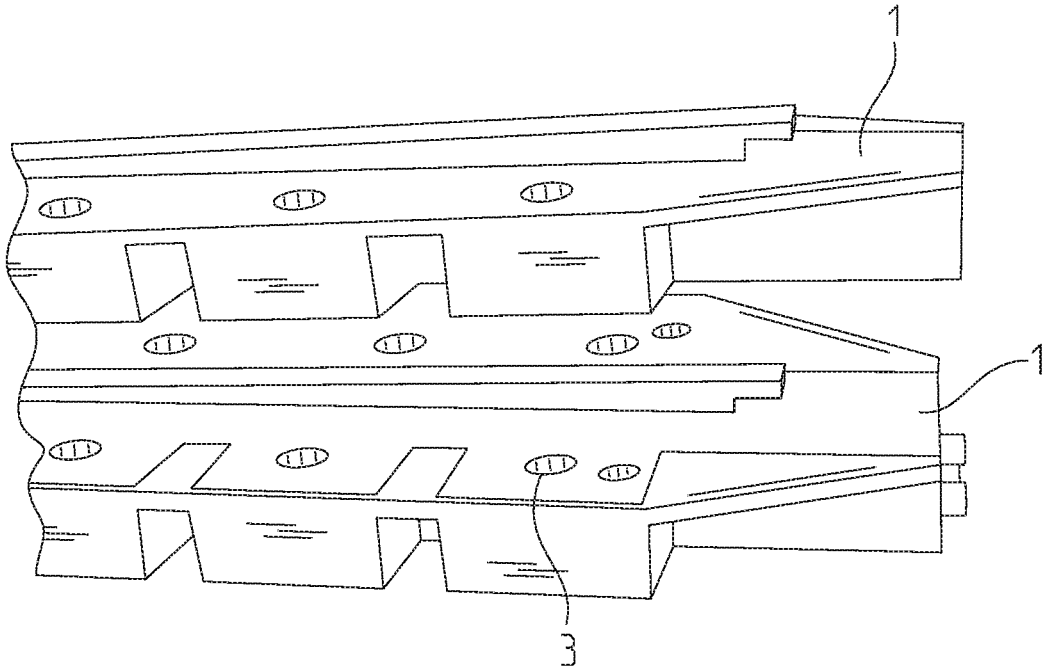
FIG. 1 shows one type of individual directional elements such as a first type of directional antenna e.g., a first type of horn antenna.

The embodiments of the invention described herein are not intended to be exhaustive or to limit the invention to precise forms disclosed. Rather, the embodiments selected for description have been chosen to enable one skilled in the art to practice the invention.

An exemplary embodiment of the invention includes an assembly fixture in a first position that holds and aligns individual elements by supporting directional elements with a machined alignment pin inserted at each element connector hole. Exemplary alignment pins sufficient for one, some or all of the elements (e.g., 66 each for one set (66) of horn antennas) are inserted into a machined track, e.g., aperture, on a fixture back plate that supports the back plane of the individual directional elements within a high precision tolerance e.g., 0.005 inches. The exemplary fixture back plate serves a dual purpose by being configured for rotating 180-degrees, so that the top left corner facing the exemplary base plate is in a second position on the bottom right corner facing the base plate, so as to accept a different category of individual directional elements which have a different back end reference datum. An embodiment of the invention maintains surface contact of individual directional elements to the assembly fixture by the use of a mechanical restraint, e.g., ratchet strap with a conforming arched wood block that applies equal pressure to each of the individual elements, and can include a step of installing end use individual element connecting rods followed by a step of torqueing to assembly end use specifications. An embodiment of the invention can include measuring equipment and an automation system which uses mathematical calculations to determine the amount of shim stock needed on, e.g., connecting rods, or between end caps or other assembly elements (e.g., between individual elements) in order to meet assembly specification tolerances, e.g., mounting hole center-to-center dimensions per, e.g., specification control drawing(s) or data. The use of an element back plate clamp for some exemplary assemblies allows for unobstructed installation of element connecting rods while maintaining element stack alignment.

Advantages of aspects of an exemplary embodiment of the invention, such as use of directional element alignment pins installed in a machined track, maintains directional element connector hole alignment requirements across all elements that make up different end assemblies e.g., a first and second type of antenna horn assembly elements used to create different directional element stacks. An exemplary fixture back plate may use an alternative embodiment using alternative alignment pins adapted for different elements can be adapted to precisely hold the different directional elements and can, for example, be rotated 180 degrees for proper assembly height for each assembly e.g., element stack. In one embodiment, element datum coupling can be a distance calculated from a mounting hole in a base plate which supports each directional element in a required orientation relative to each other and the base plate which another portion of each individual directional element rests upon.

Design of different alignment coupling/interface points, e.g., aperture/pin placement, base plate relationship with aperture pins, or addition of support structure on the base plate, can be determined by specification control drawing requirements or other datum or assembly alignment data.

An exemplary embodiment can include a base plate having a first base plate side and a first and second mounting interface structure that is provided on the base plate where each of the first and second mounting interface structures is formed with a body having a first side and a second side opposing the first side. The first and second mounting interface structures further comprise at least one mounting protrusions which can be used with an at least one end item assembly, e.g., element stack end cap. An alternate embodiment can provide an adjustable protrusion(s) or engaging structures which are enabled to engage with mounting holes of an end item frame or assembly holding structure (e.g., end caps), which is being assembled with a stack of directional elements. Each of the exemplary first and second mounting interface structures can have a first axis running through a center of each first protrusion, wherein each of the first protrusions is formed and disposed perpendicular to the first side of said body. This embodiment can also include a first elongated member, e.g, a pin with a flange on one end, formed with a first retaining section. An exemplary embodiment also has a back plate having a first length and a first height. The exemplary back plate in this embodiment is formed with a first side, a second side opposing the first side, and a lateral aperture running substantially across the first length. The exemplary back plate is adapted to receive the first elongated member, e.g., alignment pins, within the lateral aperture, wherein the retaining section is adapted to substantially fix the first elongated member with respect to the back plate such that the first elongated member passes through the first side until it comes into contact with the first retaining section and prevents the first elongated member's continued movement through the lateral aperture but still permits lateral movement of the elongated member(s) within the lateral aperture. The lateral aperture can be formed a first distance from a first end of the back plate running along the first length and a second distance from a second end of the back plate running along the first length on an opposing end from the first end, wherein the back plate has at least a first and second aperture formed respectively through a first and second area of the back plate in proximity to the first edge, the back plate has at least a third and fourth aperture formed respectively through a third and fourth area of the back plate in proximity to the second edge, wherein the back plate and the base plate are adapted to couple with each other so that the base plate and the back plate's second side is fixed substantially ninety degrees with respect to the first base plate side. Alternate orientations of the back plate to the base plate are within the scope of this invention where required to hold directional elements in a preferred orientation to facilitate alignment of the directional elements with respect to each other.

Referring initially to FIG. 1, several individual directional element assemblies are shown (in this case stacked horn antennas) with one or more orientation relationships between the directional elements 1. FIG. 1 shows directional elements 1 with connecting rod holes 3 and other elements which play an alignment or fit role in an assembly of these directional element assemblies.

Figure 2:
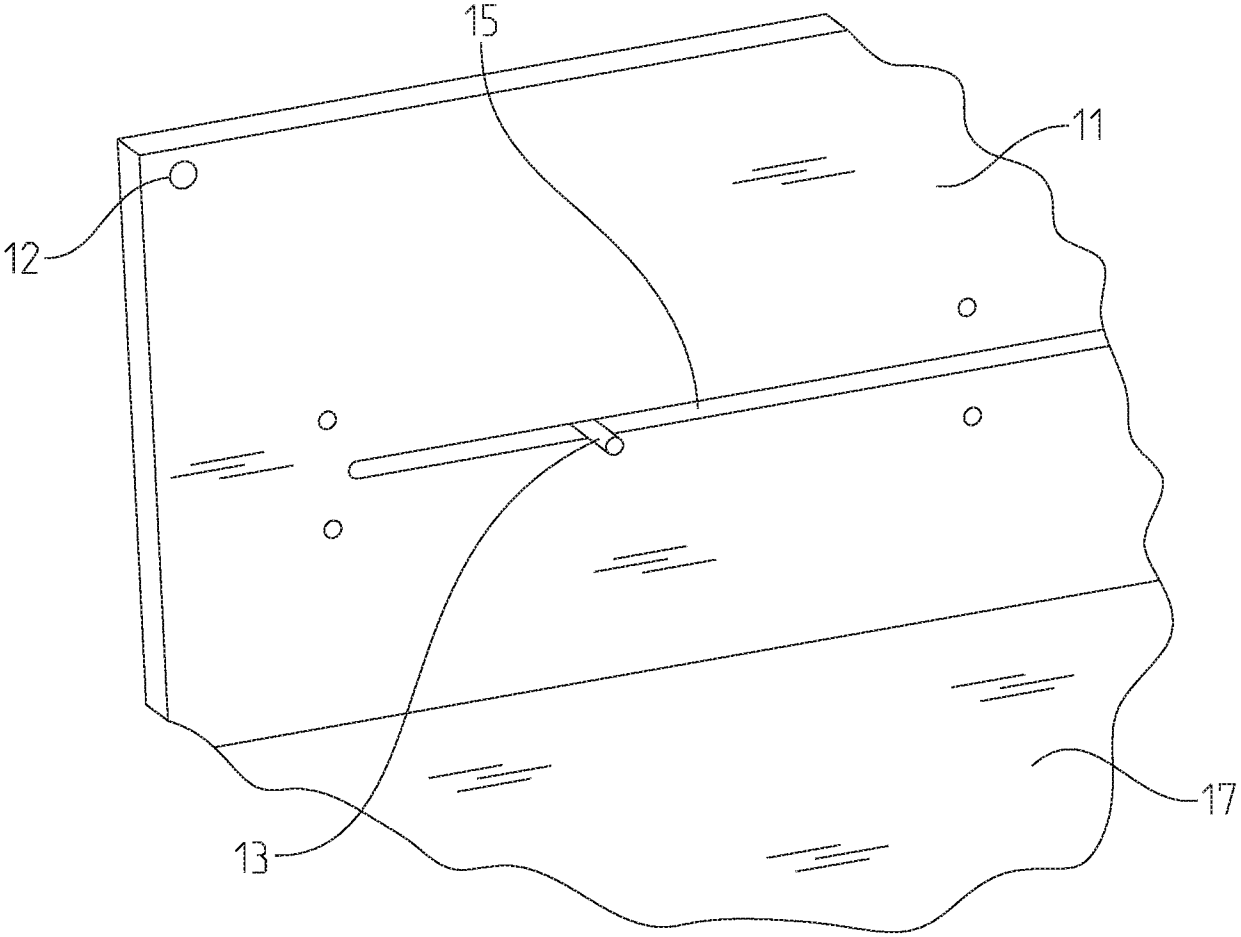
FIG. 2 shows an exemplary back plate with an alignment pin installed in a back plate in relation to a base plate.

FIG. 2 shows an exemplary back plate 11 with an alignment pin 13 extending through a lateral aperture 15 formed to accommodate a plurality of alignment pins 13 configured to engage with an aperture in directional element. One of a plurality of alignment pins 13 is associated with each element 51 or element 1 which are collectively assembled into an element stack 55, 23 (e.g., see FIG. 12 and FIG. 4). Back plate 11 can be rotated 180 degrees from its position with regards to an apparatus shown in FIGS. 1-6 which enables use with a different set or category of directional elements (e.g., see FIG. 8-15) and coupled to the base plate 17 which positions the alignment pins in the lateral aperture 15 in a different alignment location, e.g., a different lateral distance from base plate 17. The lateral aperture 15 has a first distance from an edge in proximity to the base plate 17 and the aperture 15 in one orientation associated with a first alignment position of a first category of directional elements and a second distance from a different edge in proximity to the base plate 17 and the aperture 15 in a second orientation (e.g., rotated 180 degrees) associated with a second category of directional elements. In this example, one of four back plate mounting holes 12 is shown which is used to mount back plate 11 to base plate 17 when the back plate 11 is rotated 180 degrees to the second orientation position. In an exemplary process, an operator would install the alignment pin 13 through a lateral aperture 15 of a back plate 11 and into alignment locations of individual elements, e.g., antenna element assembly fixture. An operator would next position elements so that they are supported by a respective alignment pin 13 installed into an alignment location, e.g., connector port, on a datum point of the element (in this case, a rear surface port for an element). Elements, such as shown in FIG. 1, interlock with each other. Therefore, it may be necessary to assemble several elements at one time and install on the exemplary element assembly and alignment fixture, or the elements can be assembled one at a time by positioning them to insert the alignment pin 13 into a respective element. An alignment fixture, e.g., a framing square 14 (not shown), can also be placed against back plate 11 to ensure a required alignment of an element to the back plate 11, e.g., 90 degrees square.

Figure 3:
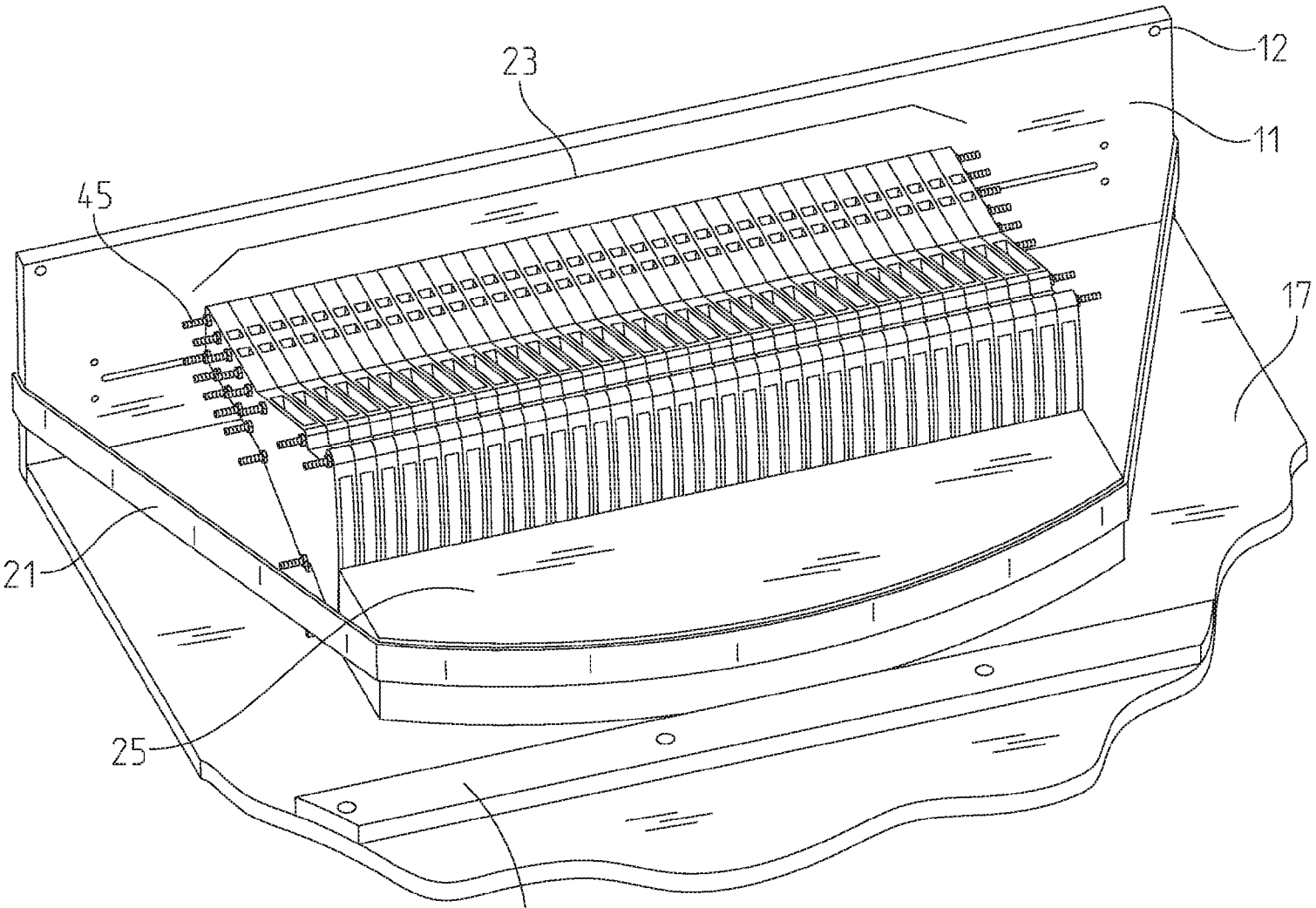
FIG. 3 shows an exemplary partially assembled directional element stack on a FIG. 2 exemplary embodiment.

Referring to FIG. 3, a next step can include strapping an assembly of antenna elements, e.g., elements 1, (hereinafter "element stack" 23), using a ratchet strap 21 around an arched wood blocks 25 on one side and the back plate 11. Wood blocks 25 are used in this embodiment to protect the element stack 23 from being scratched or damaged while force is applied to them. In this embodiment a wood block 25 can be placed between the element stack 23 and a back stop structure 83 to ensure proper support for wood block 25. The ratchet strap 21 permits selective tightening/release to permit measurement and alignment of the element stack to a desired close tolerance. In this example, a step can include installation of all threaded connecting rods 45 (which includes flat washers, locking nuts, and hex nuts) and tightening of connecting rods 45 equally from front to rear of the assembly. Another step can include application of a slight pressure at a front of each directional element 1, e.g., antenna horn element, to seat each element 1 against the back plate 11 of the assembly and alignment fixture. An operator may find it necessary to tap one or more of the elements 1 with a rubber mallet to seat each element 1 as the connecting rods 45 are tightened equally.

Another step can include applying a finish torque, e.g., 50 inch pounds, on each of all threaded connecting rods 45. Another step can include insertion of a feeler gage between each element 1 and back plate 11 of the fixture and, for example, ensuring a 0.004 inch feeler gage will not insert easily.

Figure 13:
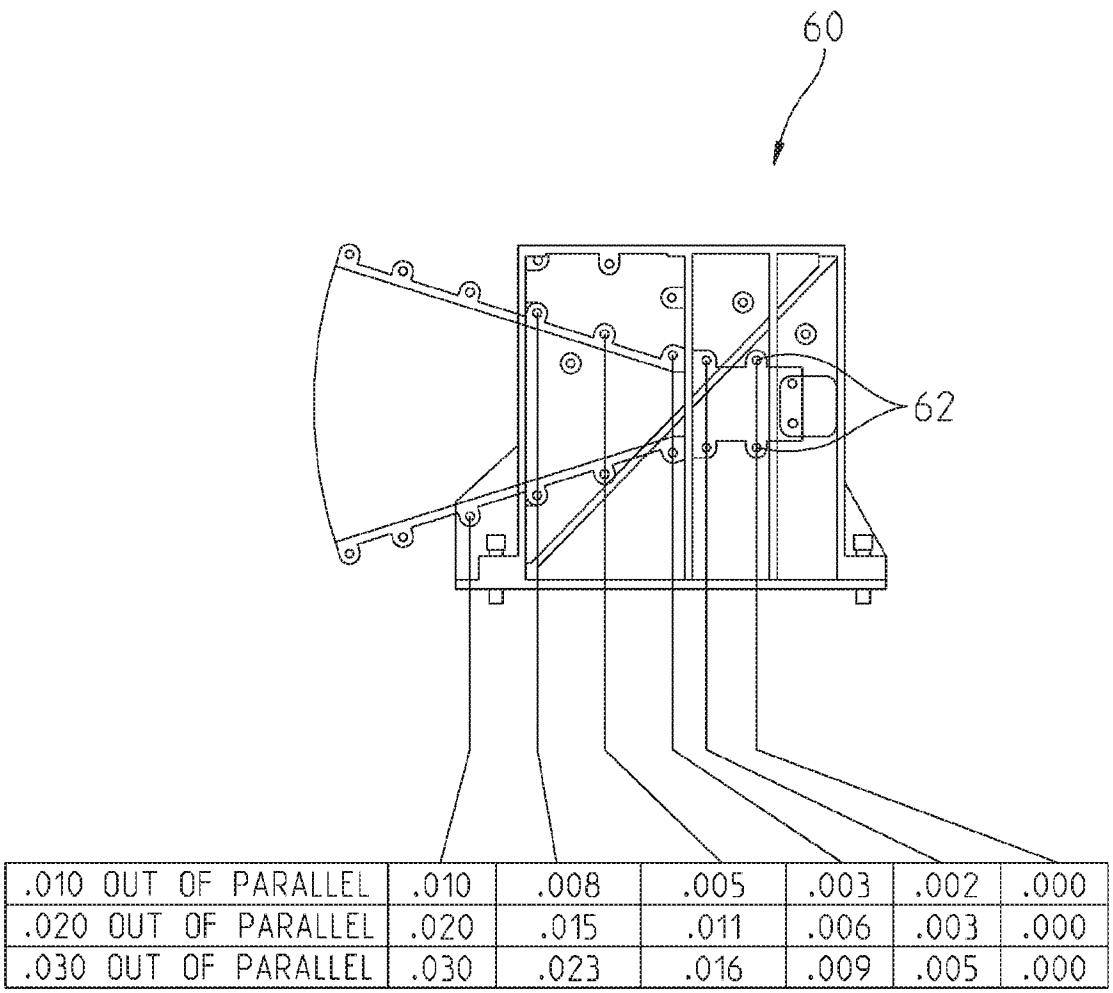
FIG. 13 shows an example of a diagram showing "measured difference" between front mounting holes and rear mounting holes of a stack of directional elements.

Another step associated with use of an exemplary embodiment of the invention can include removal of pressure applied to a front of the element stack 23, e.g., horn antenna assembly, and measure a width of the element stack 23 with a Versa Gage 91 as shown in FIG. 13. An operator can measure a distance from an end cap 31, 31' mounting hole edge to the edge of end cap casting (element side). This measurement can be accomplished prior to disassembly and documented on masking tape and affixed to an end cap for reference (See FIG. 5). An operator can subtract both end cap measurements, element stack and one mounting hole diameter from a predetermined value, e.g., 26.514 inches, to produce a required shim dimension.

Figure 4:
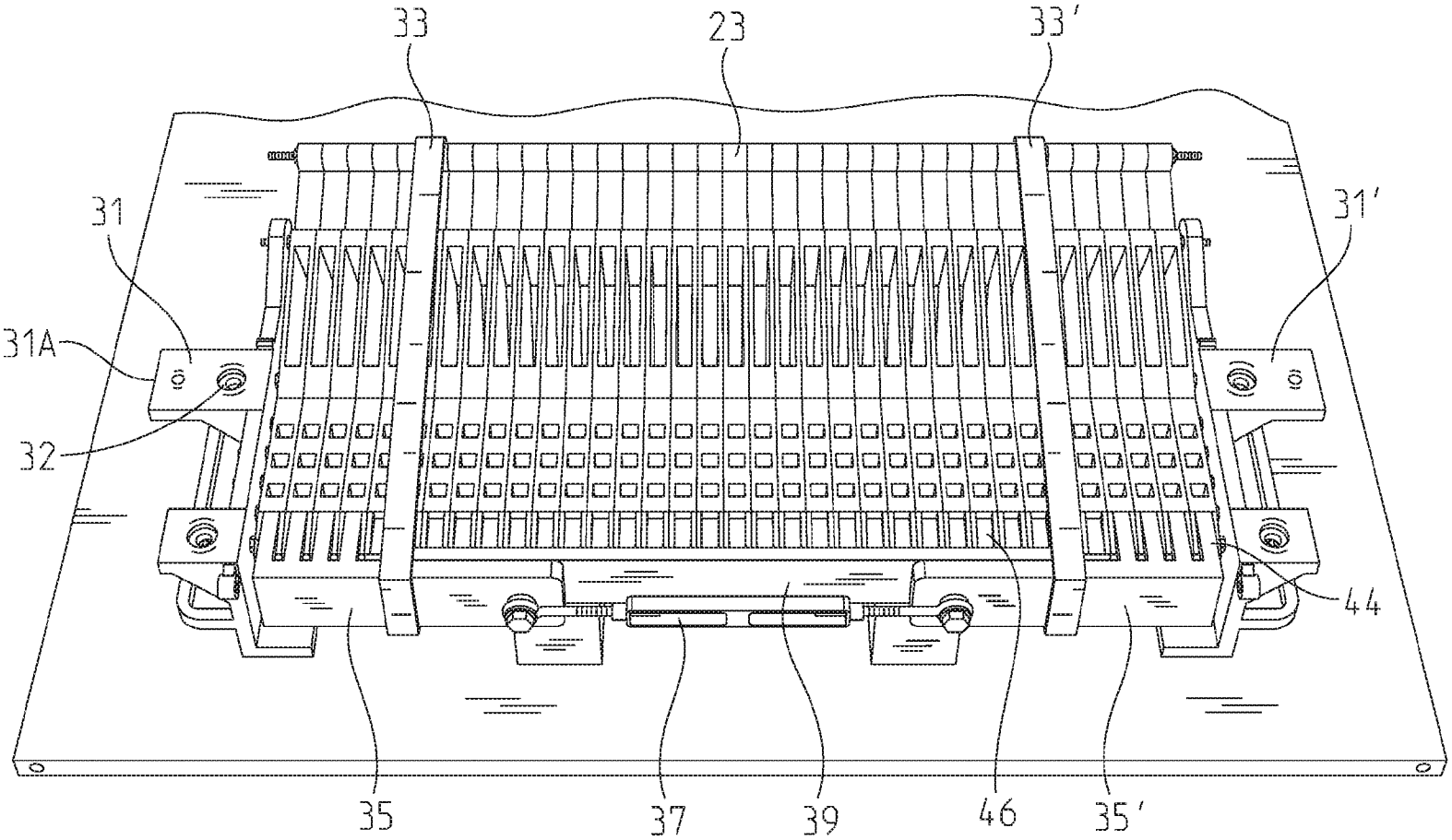
FIG. 4 shows an exemplary partially assembled directional element stack in a further segment of an assembly process using the FIG. 2 exemplary embodiment.

Referring to FIG. 4, another step can include installing end caps 31, 31' on opposing ends of the element stack 23 which are coupled together by connecting rods (not shown). The end caps 31, 31' have apertures along a perimeter or edges of the end cap which receive connecting rods. The end caps 31, 31' are formed with mounting flanges 31A having a mounting hole 32 where the end caps, 31, 31' mounting flanges 31A, and mounting holes 32 are adapted to be used to mount the element stack 23 in an end application thus simplifying the element stack 23 and assembly fixture. A first finger bracket 35 and second finger bracket 35' comprising a structure including a plurality of protrusions 44 adapted to insert into a respective plurality of apertures 46 formed by the directional elements 1 in the element stack 23 on opposing ends of the element stack 23. An adjustable tensioner 37, e.g., a turnbuckle, is provided and adapted to selectively couple and apply a compressive force on the first and second finger brackets 35, 35'. The adjustable tensioner 37 and first and second finger brackets 35, 35' are adapted to selectively apply compressive force on the element stack 23. A first ratchet strap 33 and second ratchet strap 33' is provided to couple around the element stack 23 and the first and second finger brackets 35, 35' to apply a compressive force on the element stack 23. An operator can remove the ratchet strap 21 and arched wood block 25 from FIG. 3 and then can install the first and second finger brackets 35, 35' plus adjustable tensioner 37. Small ratchet straps 33, 33' can be used to prevent the finger brackets 35, 35' and adjustable tensioner 37 from slipping off the element stack 23. A wood spacer structure 39 can be inserted in between the element stack 23 and the finger brackets 35, 35' to prevent damage to element stack 23 and stabilize finger brackets 35, 35'. An operator can torque sufficiently and remove threaded connecting rods 45 necessary to install the end caps 31, 31'.

Figure 5:
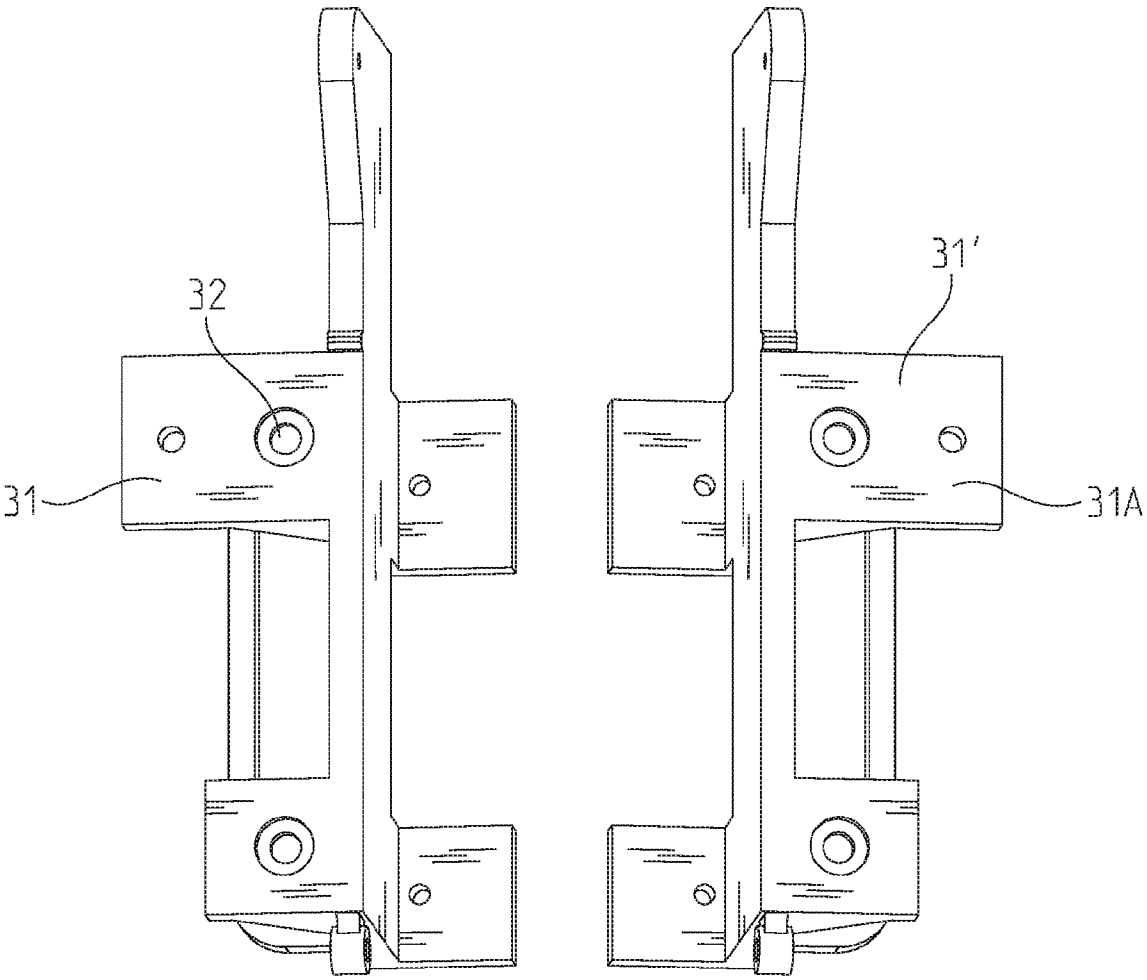
FIG. 5 shows a top view of an end cap used with an exemplary embodiment of the invention and directional elements such as shown in FIG. 1.

FIG. 5 shows an alternative view of the end caps 31, 31'. End cap mounting flanges 31A and mounting hole 32 are more clearly depicted which provide end support for the element stack 23 during assembly and use in an in-service field installation. One advantage of the invention is using in-service mounting structures, such as end caps, with an assembly and alignment structure in order to avoid a need to conduct further calibration of an element stack 23 after alignment and assembly.

Figure 6:
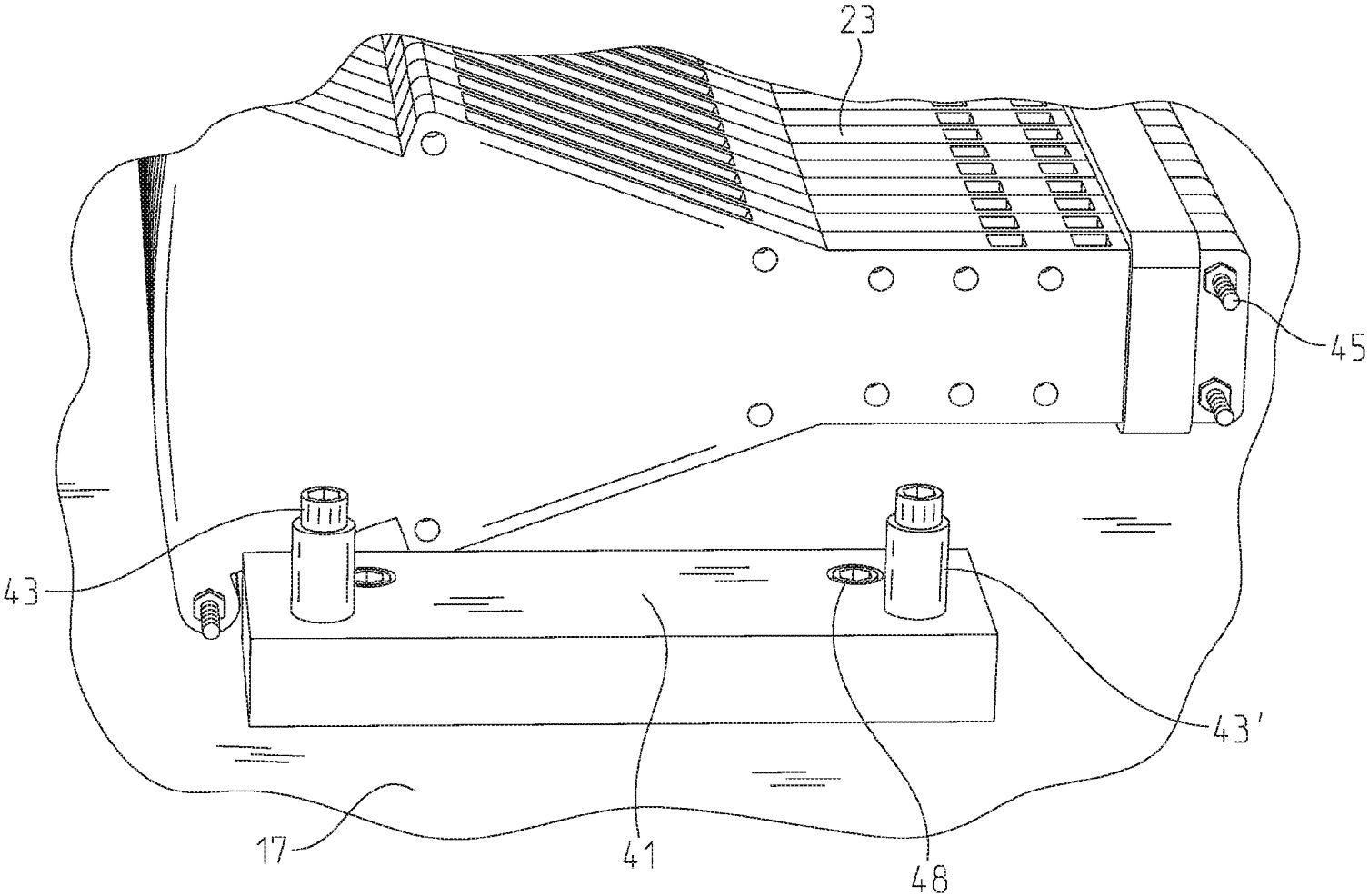
FIG. 6 shows a view of one alignment mounting structures which are mounted on the base plate and used to couple end caps in accordance with one embodiment of the invention.

FIG. 6 shows a view of one alignment mounting structures 41 which are mounted on a base plate 17 adapted to couple with end caps 31, 31'. An embodiment can also include another alignment mounting structure 41 on an opposing side of base plate 17 in proximity to an opposite end of an element stack 23. The alignment mounting structure 41 can be attached/removed from base plate 17 by connecting structures 48 that secure mounting structure 41 to base plate 17. Mounting structure 41 can comprise apertures 42 (see FIG. 11) adapted to hold removable protrusions, e.g., cylindrical structures, 43, 43', which engages into mounting holes 32 in mounting flanges 31A. The figure also shows an end of connecting rods 45 which are used in part to align the element stack 23 with respect to alignment mounting structures 41 per predetermined specification mounting distances. Another step can include assembling both end caps 31, 31' to the element stack 23 after calculating shim requirements. After assembly, another step can include verification that elements 1 in the element stack 23 meets specifications by measuring with a Versa Gage, mounting hole 32 center to center distance e.g., 26.50+/−0.014 in. (e.g., min/max=26.486-26.514). If dimensions do not meet print tolerance steps above can be repeated.

Figure 7:
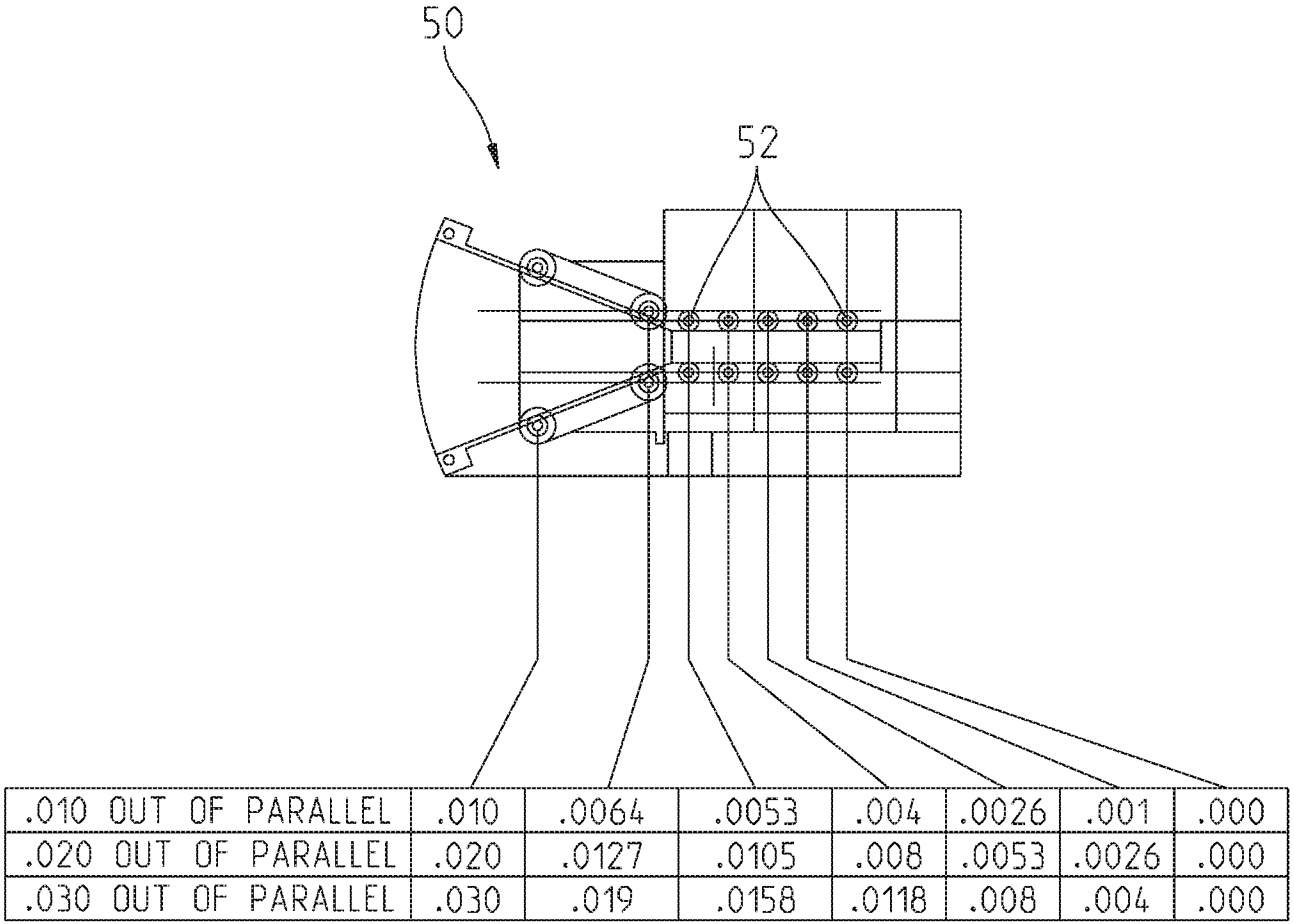
FIG. 7 shows an example of a diagram showing "measured difference" between front mounting holes and rear mounting holes of an element stack including a number of directional elements, e.g., of a first type.

FIG. 7 shows an example of a diagram 50 showing "measured difference" at each plurality of casting mounting holes 52 if it is "out of parallel" by 0.010; 0.020; 0.030, between mounting holes on one side of element stack 23 and mounting holes on an opposing side of element stack 23. Using these numbers allows a user to calculate the number of shims required to achieve proper alignment tolerances of an element stack 23.

Figure 8:
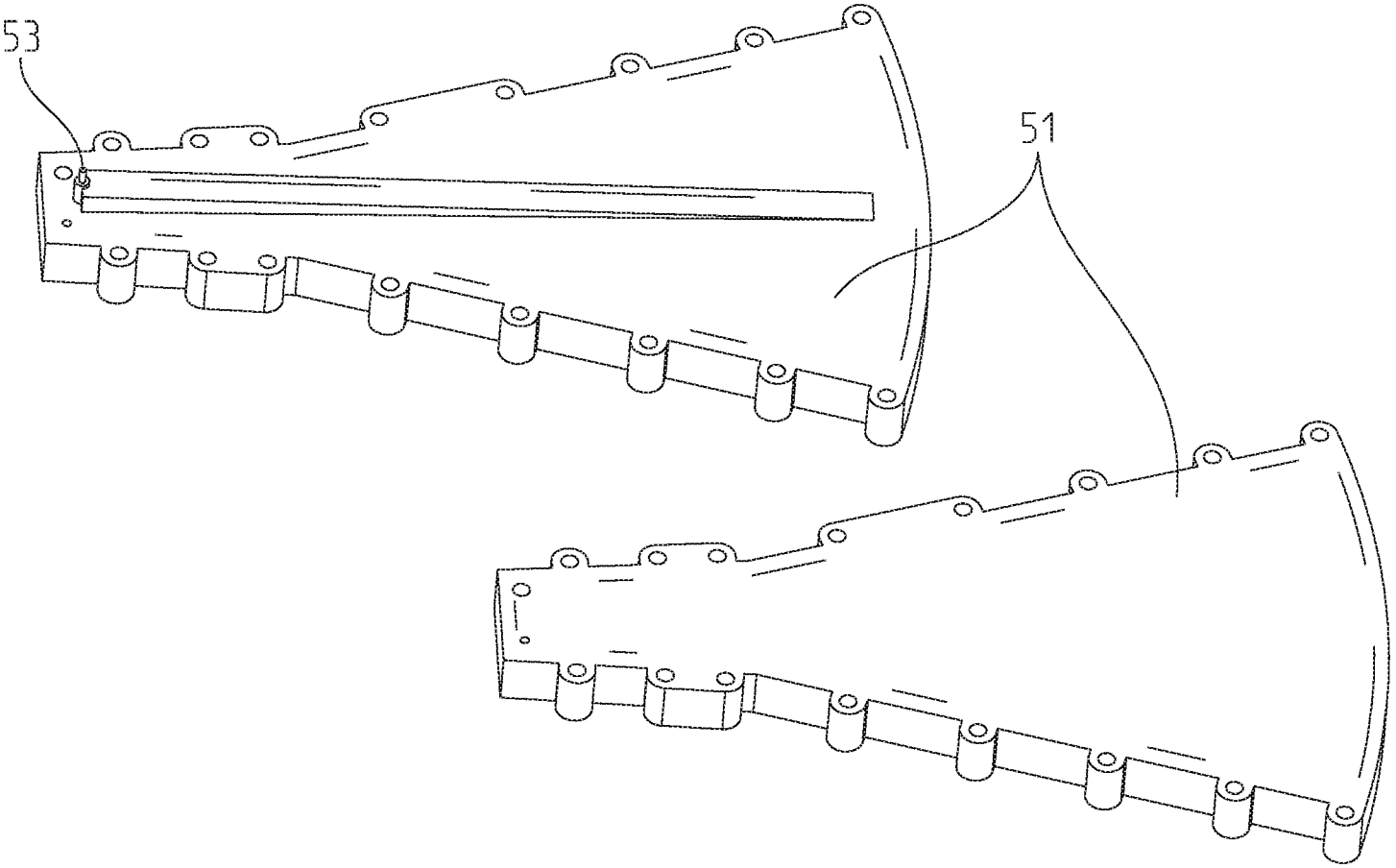
FIG. 8 shows different set of directional elements which are assembled in an exemplary embodiment of the invention.

FIG. 8 shows an alternative set of elements 51 which are assembled in an exemplary assembly fixture (not shown). One aspect of elements 51 includes an injector pin 53 which is used in part to align an alternative element stack 55.

Figure 9:
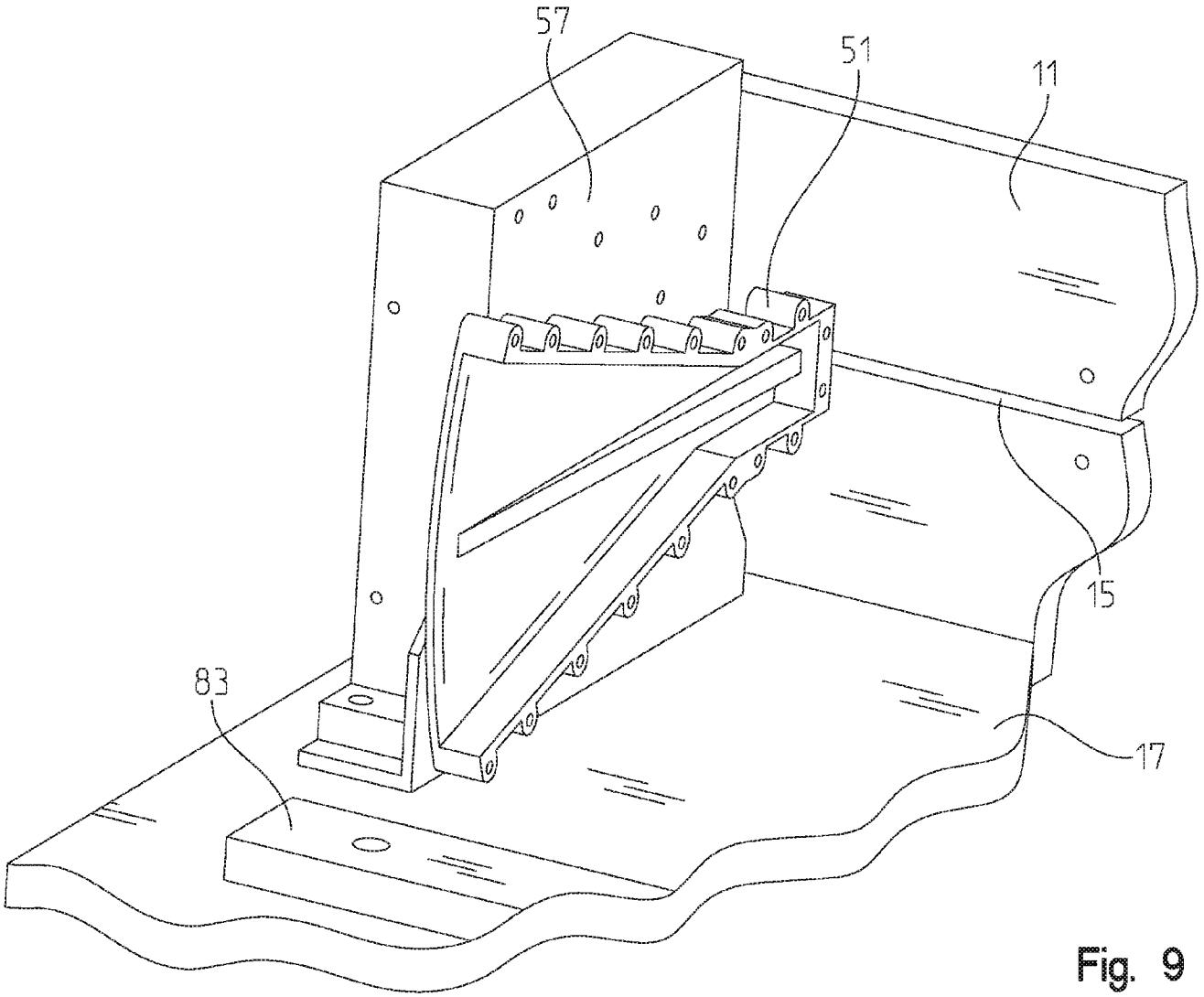
FIG. 9 shows an exemplary back plate and base plate abutting and supporting an end cap and an second directional element type.

FIG. 9 shows the back plate 11 and the base plate 17 abutting and supporting an end cap 57 and an element 51 abutting the end cap 57 as well as the back plate 11. The surface of element 51 closest to back plate 11 is aligned with aperture 15 so that an alignment pin 13 can properly engage with alignment location of element 51. In this embodiment the back plate 11 is flipped 180 degrees from the orientation shown in FIGS. 1-6 in order to assemble alternative elements 51 into an alternative element stack 55.

Figure 10:
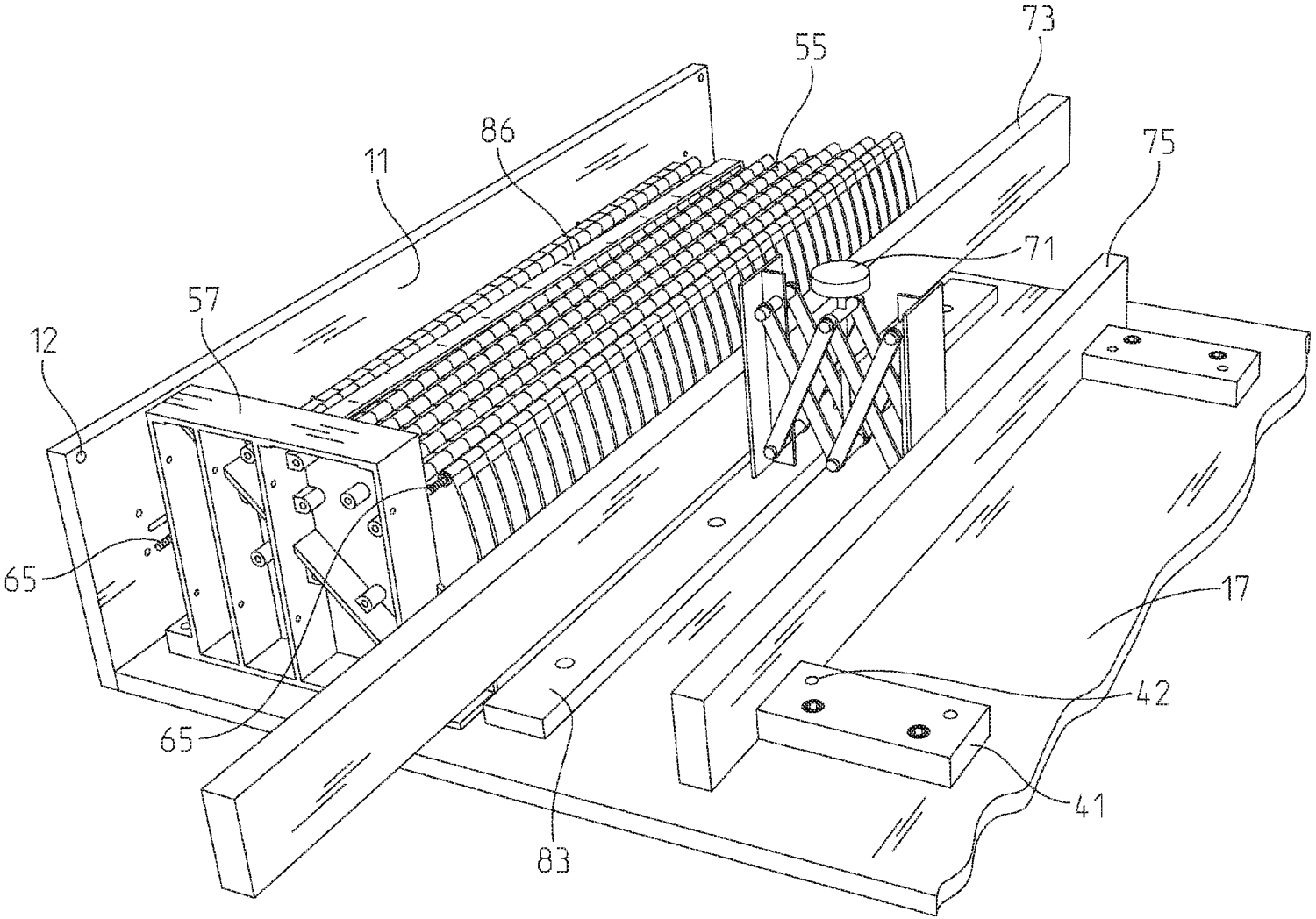
FIG. 10 shows an exemplary element stack of directional elements coupled together with connecting rods through apertures around perimeter edges of end cap and compression mechanism.

FIG. 10 shows exemplary element stack 55 coupled together with connecting rods 65 through apertures around perimeter edges of the end cap. The connecting rods 65 pass through each of the elements 51 and another end cap (not shown) which in this embodiment is an opposing version of the end cap 57. A wood structure 73 is placed against a face of the element stack 55 that is on an opposite side which abuts the back plate 11. Another wood structure 75 is placed against a mounting structure 41 on the base plate 17. A scissor jack 71 that has a threaded axle which extends or retracts the scissor jack 71 is placed between the two wood structures 71, 73 which applies or releases pressure against the element stack to press it against the back plate 11. The back plate 11 aperture 15 has a different distance from an edge in proximity to the base plate 17 in the first orientation of the back plate 11 such as in FIGS. 1-6 thus accommodates alignment and orientation of the different elements 51 and element stack 55 than accommodated in FIGS. 1-6. An adjustable strap 86 can also be provided to apply compressive force along an axis running along a length of the element stack 55.

An operator can assemble elements 51 one at a time by placing an element alignment location on a back side of the elements 51 with a corresponding alignment pin 13, and sliding each element into position adjacent to each other and end cap 57 and abutting the back plate 11 until all elements 51 are in place in the element stack 55. Element 51 castings are pinned together using solid pins (not shown) while slight tapping with a rubber mallet may be required to seat elements. After installing end cap 57, then an operator can install an adjustable strap 86 to an entire element stack.

An operator can install, e.g., connecting rods 65, flat washers, locking nuts, and hex nuts. An operator can apply slight pressure at a front of the element stack 55, e.g. horn antennas, to seat elements 51 against the back plate 11. Next, an operator can remove pressure applied to a front of the antenna stack 55 and measure widths of the element stack 55 with a Versa gage. This can be accomplished prior to assembly and documented on masking tape and affixed to an end cap 57 for reference. An operator can determine shim dimensions using a measurement process in view of an available shim or shim widths. For example, an operator can subtract both end cap measurements, element stack and one mounting hole diameter from a predetermined value e.g., 34.000 inches to obtain a required shim dimension; an operator can divide this required shim dimension number by two to get a number of available shims associated with available dimensions on each side.

Figure 11:
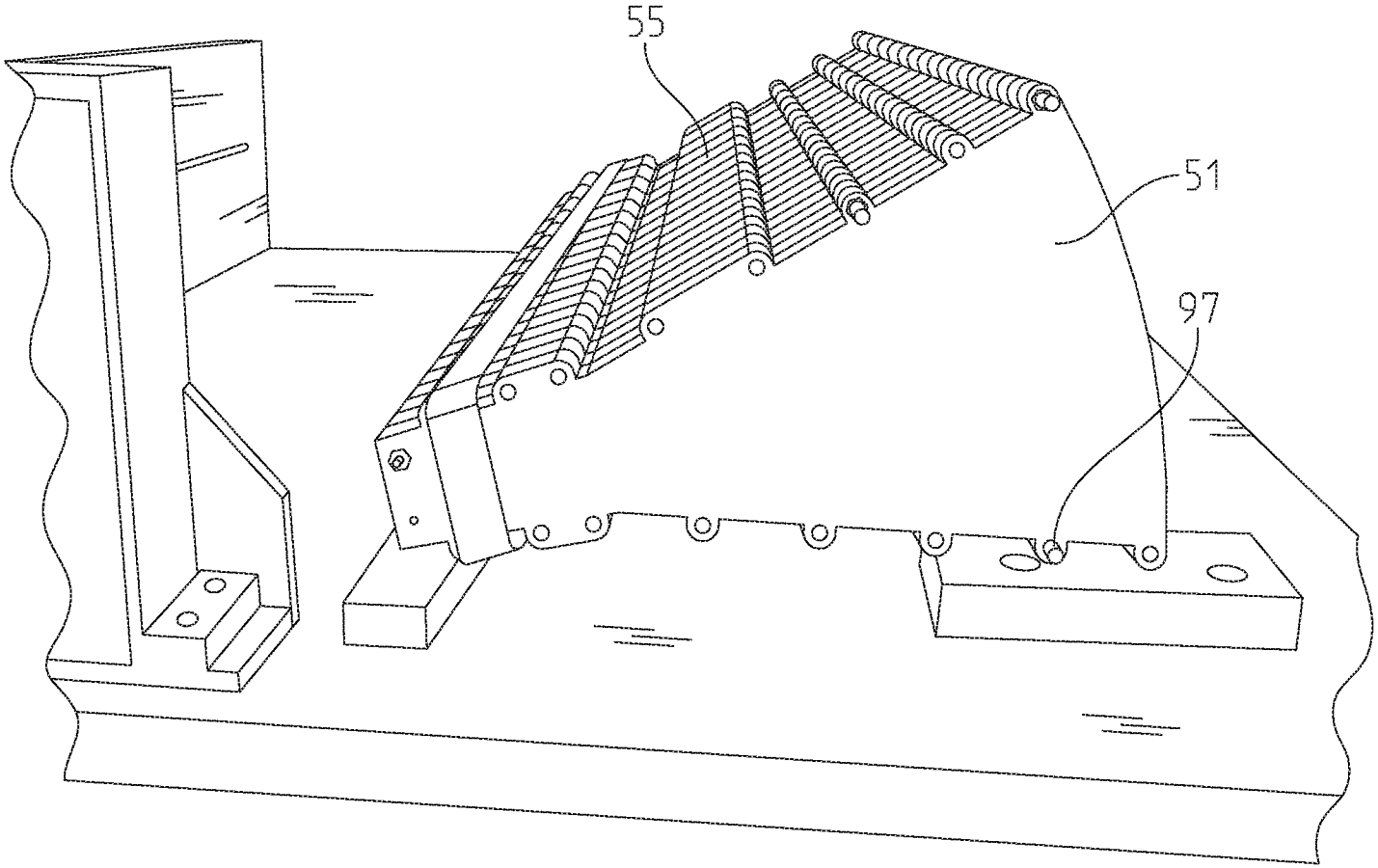
FIG. 11 shows an element stack including directional elements with connecting rod apertures around a perimeter of the elements.

FIG. 11 shows another view of exemplary element stack 55 with connecting rod apertures 97 around a perimeter of the elements 51.

Figure 12:
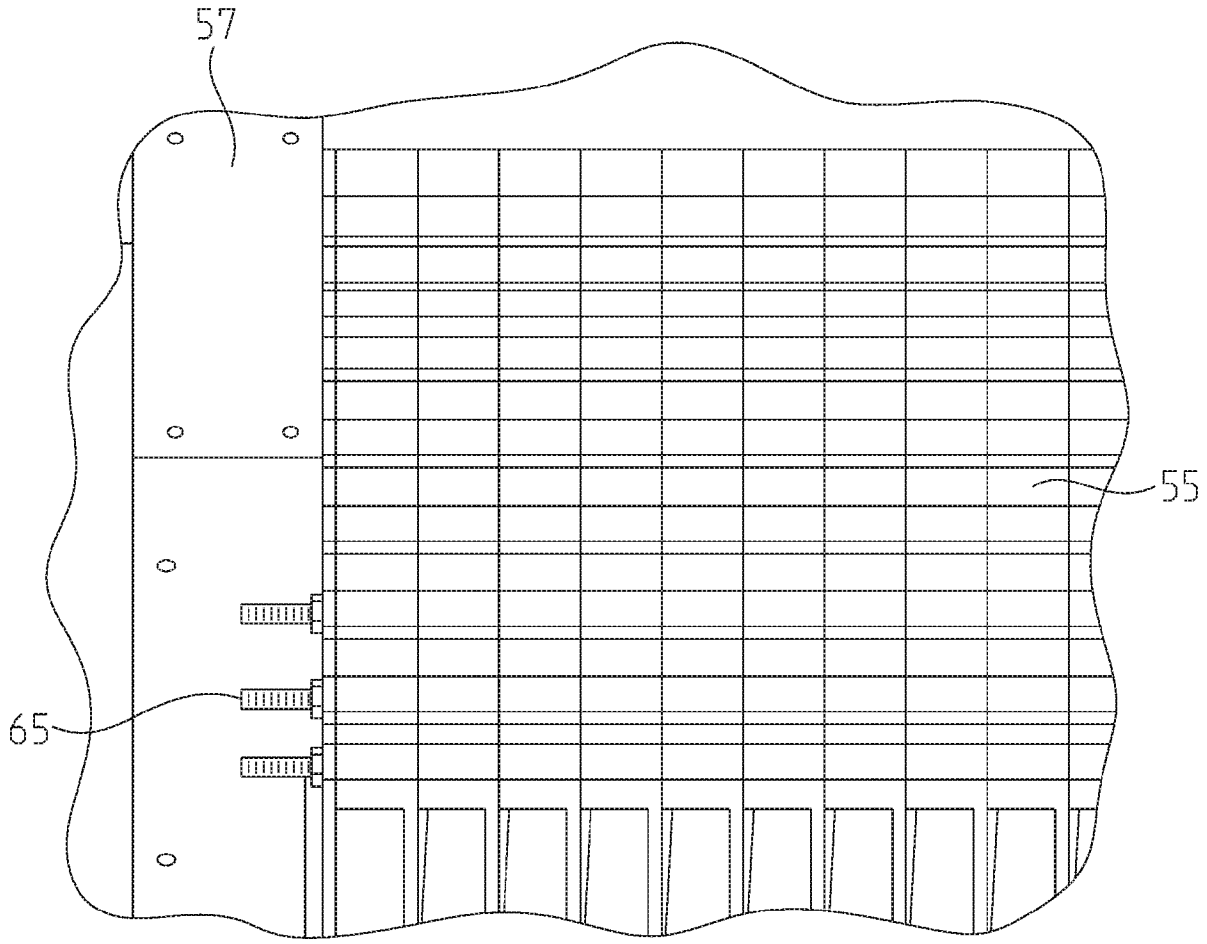
FIG. 12 shows a perspective view of one end of a stack of directional elements with an end cap on an end of the stack of directional elements.

FIG. 12 shows a perspective view of one end of the element stack 55 with an end cap 57 on an end of the element stack 55. A shim (not visible) can be placed between a nut on the connecting rods 65 to make fine alignment modifications of the elements 51 in the element stack 55 in order to being element stack 55 within predetermined alignment tolerances.

FIG. 13 shows an example of a specification diagram 60 used with one embodiment of the invention showing "measured difference" at each plurality of casting mounting holes 62 if it is "out of parallel" by 0.010; 0.020; 0.030, between mounting holes on one side of element stack 55 and mounting holes on an opposing side of element stack 55. Using these numbers allows a user to calculate the number of shims required to achieve proper alignment tolerances of an exemplary element stack 55.

Figure 14A:
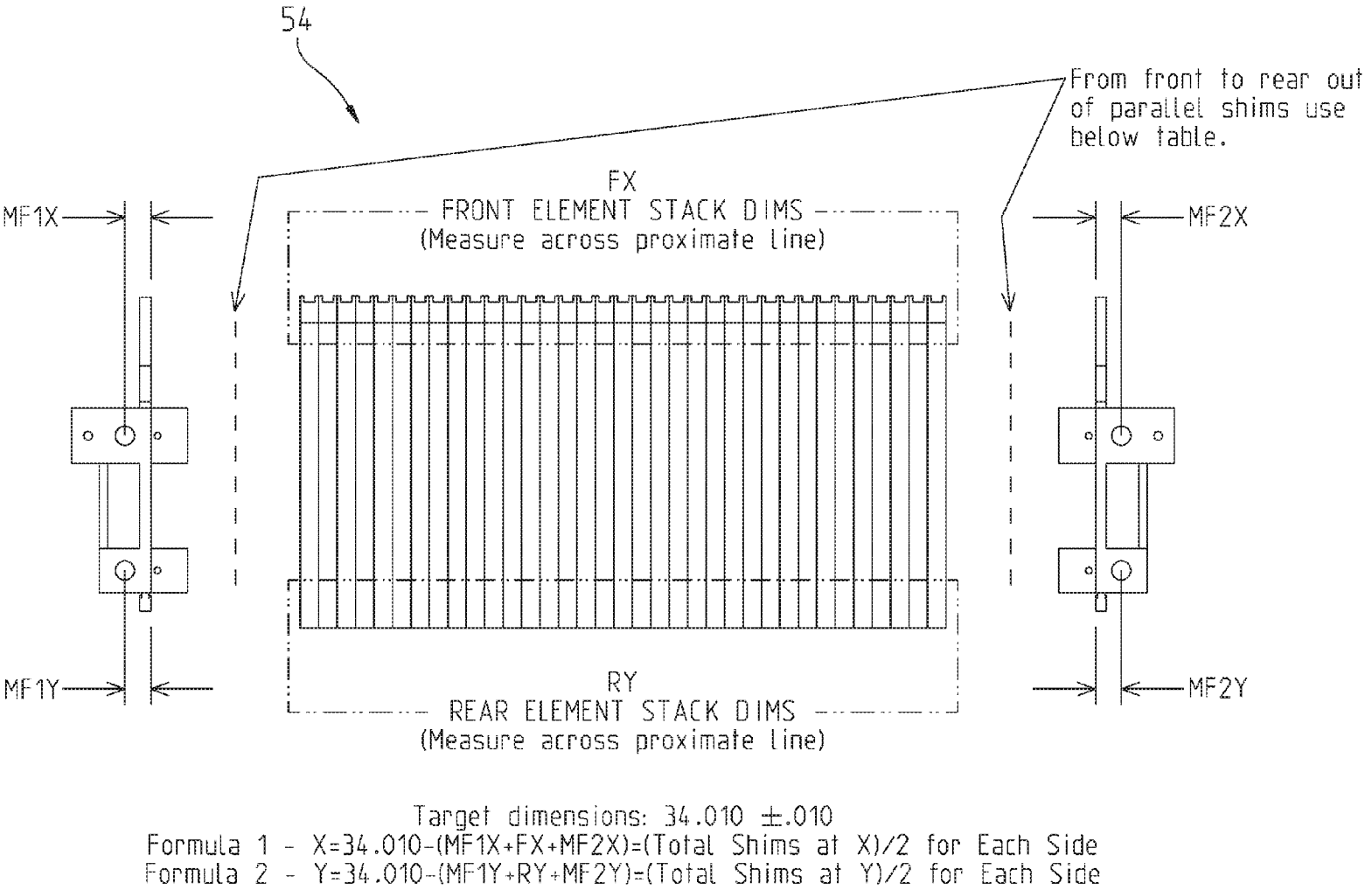
FIGS. 14A and 14B show a depiction of a top down view of structures shown in FIG. 7.
Figure 14B:
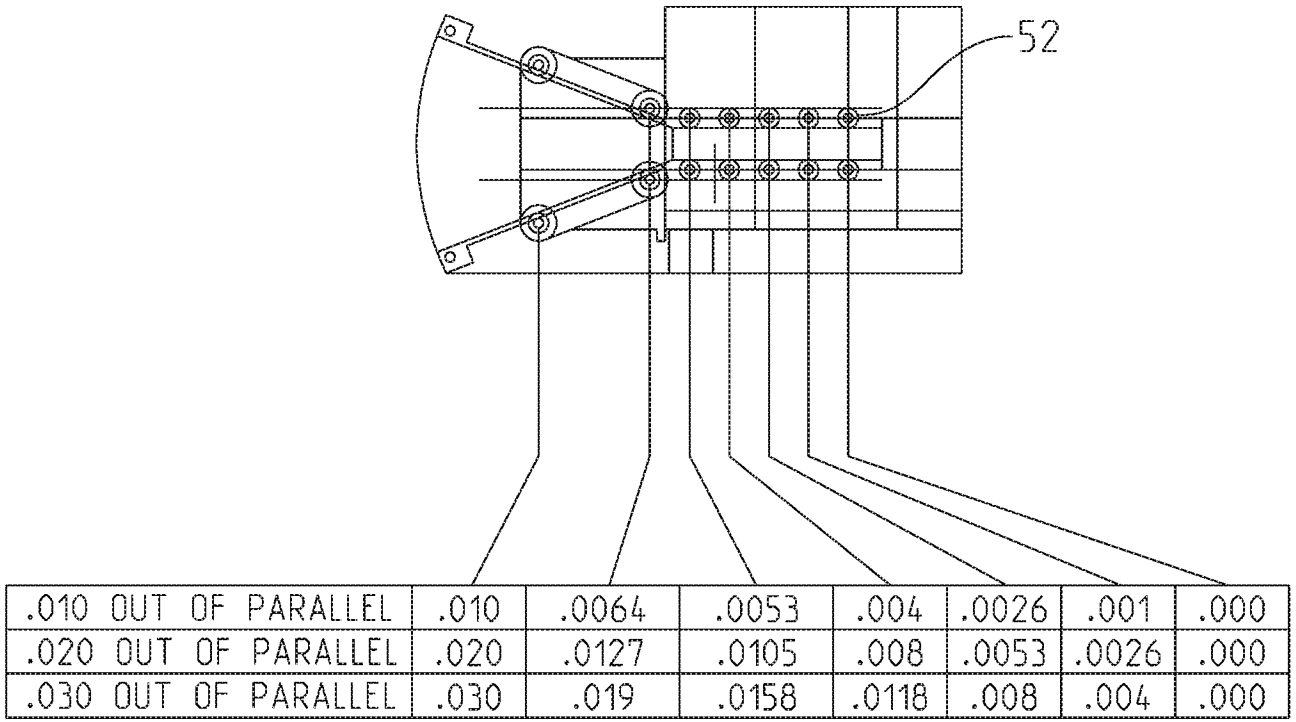

FIGS. 14A and 14B show a depiction of additional locations of measurements associated with alignment tolerance datums used with an embodiment of the invention. Also shown is are exemplary formulas for determining alignment by use of a target dimension number associated with an exemplary antenna stack e.g., 34.010 inches which is used relative to calculating shims for each side. Also shown are exemplary out of parallel shim selection/placement tables associated with different shim points. Different measurement points are shown e.g., FX (across front element stack), FY (across rear element stack), etc.

Figure 15:
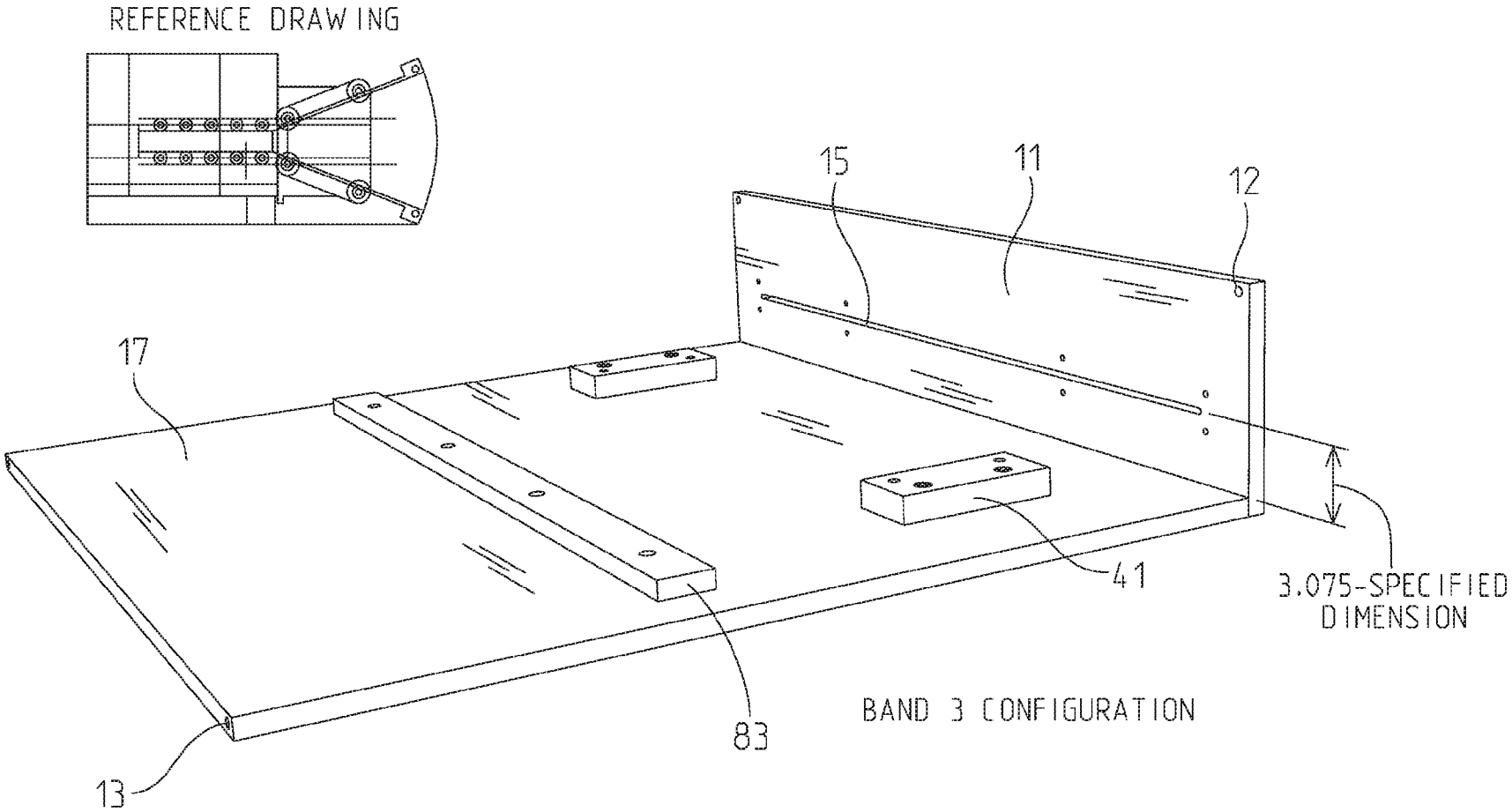
FIG. 15 shows an exemplary base plate and an exemplary back plate in one configuration associated with one type of a stack of directional elements.

FIG. 15 shows an exemplary base plate 17 and an exemplary back plate 11 in one configuration. An inset diagram of an exemplary horn antenna stack from an end view is shown in an upper left hand corner. The back plate lateral aperture 15 in this exemplary configuration is positioned on the side of said base plate 17 closest to mounting structure 41. In this configuration back plate lateral aperture 15 is also closest to said base plate 17, e.g., a 3.075 specific dimension.

Figure 16:
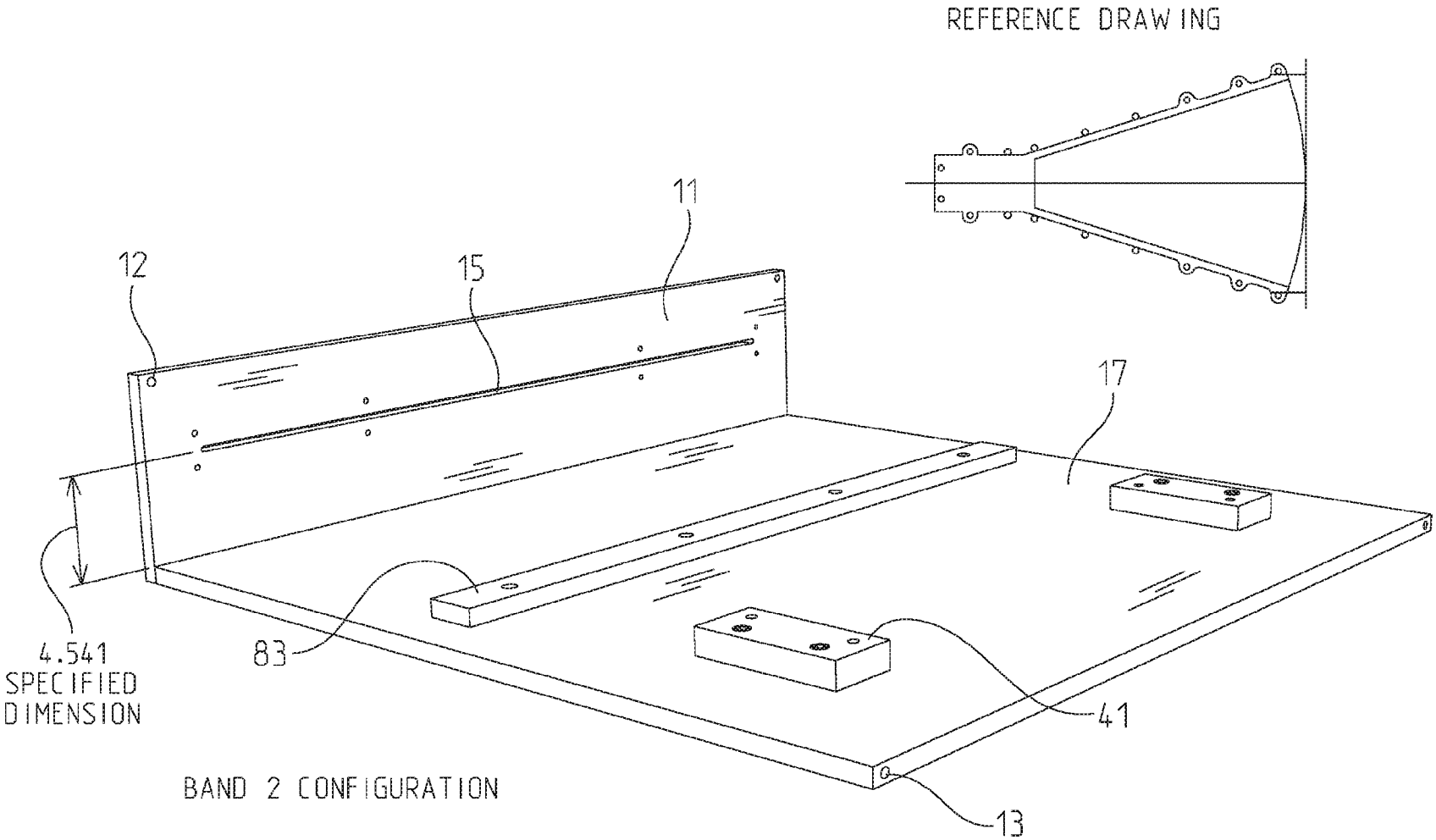
FIG. 16 shows an exemplary base plate and an exemplary back plate wherein the back plate is rotated 180 degrees and attached to the base plate's opposite side which is configured to attach to the base plate in another configuration associated with assembly of a different stack of directional elements.

FIG. 16 shows an exemplary base plate 17 and an exemplary back plate 11 wherein a back plate 11 is rotated 180 degrees and attached to a base plate's 17 opposite side farthest from mounting structure 41. In this configuration back plate lateral aperture 15 is at a greater distance from said base plate 17, e.g., a 4.541 specified dimension. Back plate mounting holes 12 is shown which is used to mount back plate 11 to base plate 17 at base plate mounting hole 13. Base plate 17 has 4 base plate mounting holes 13 to match corresponding back plate mounting holes 12.

FIGS. 17A and 17B are an exemplary alignment and assembly process used with a first type of directional element, e.g., a first type horn antenna assembly. An alignment and assembly apparatus is provided such as discussed herein. Next, at step 300, position back plate in appropriate configuration in relation to the base plate so that back plate aperture and alignment pins are in the predetermined position to align with one category of directional elements. At step 301, obtain one or more reference measurements associated with the one category (e.g., first category) of directional elements including dimensions. For example, measure the one category, e.g., horn antenna, assembly mounting hole distances using VERSA GAUGE and record the distance measurements. At step 302, disassemble for blast coating. For example, lay the directional element assembly flat on a base configured in accordance with an embodiment of the invention with end cap mounting holes down and remove all-thread rods connecting end caps to a directional element stack. Remove end caps while supporting the element stack on the alignment and assembly apparatus for removal of remaining rods. Next, remove remaining rods and carefully disassemble elements from each other afterwards removing all connectors from each element and reinstalling connector mounting screws into each element. At step 303, inspect all components. For example, a user should inspect all elements for damaged to mating surfaces, i.e., inspect element signal surfaces for voids in casting; inspect element roll pins for damage and perpendicular alignment to element. At step 304, reassemble element components. For example, step 305 install right side the first category of directional elements end cap, e.g., first type horn assembly end cap, (left looking at fixture) with two mounting bolts to the base plate of the fixture using a framing square as a guide to ensure the end cap is perpendicular to the back plate before applying torque to bolts. At step 306, begin sequentially install the directional elements by aligning each element connector hole onto a respective alignment pin making sure each element is seated against the first category end cap. At step 307, install a next element by aligning connector hole to alignment pin and lock into previous element. At step 308, process steps 306, 307 should continue until all directional elements have been stacked together. At step 309, install an opposing first category element end cap on an opposing side of the assembled element stack that the end cap installed at step 305 to complete the directional element stack. At step 310, secure the element stack with a ratchet strap to keep the directional element stack or assembly together.

At step 311, apply pressure to a front side of the assembly of first category of directional elements using a large ratchet strap/wood block then inspect to ensure all elements are seated against the back plate of alignment and assembly fixture. At step 312, begin installing all threaded rods and placing/inserting nuts on threaded rods. For example, using a feeler gauge on those elements that do not appear seated to an adjacent element to ensure that elements are within alignment tolerance. Gently tap unseated elements with a rubber mallet as torque is applied to all threaded rods in element stack to ensure elements remain seated as rods are tightened. At step 313, apply predetermined final torque on installed rods. At step 314 refer to reference measurement, measure outside of element stack to check for a wedge, or out of parallel condition, and compute needed shims required to bring elements within predetermined tolerances. At step 315, apply fine adjustments to one or more elements in the element stack to conform to predetermined dimensional and element relationship tolerances and specifications. For example, after computing needed shims required to align out-of tolerance element(s), loosen pressure on the element stack slightly by loosening the nuts to allow application of even amounts of shims to one or each side of an out-of-tolerance element(s). At step 316, tighten straps, apply final torque and repeat measurement, loosening, calculation and addition of required shims until predetermined alignment of said elements are achieved. Install threaded rods, nuts, shims and other hardware and torque to required torque using a predetermined torque pattern trying to obtain even amounts of visible thread on all thread rods as it passes through end cap. At step 317, verify specification measurements and repeat above steps as required. For example, ensure assembly meets predetermined dimensions. If the assembly does not meet predetermined dimensions repeat above steps and add or remove shims as appropriate.

FIGS. 18A and 18B show an exemplary assembly process for maintaining tolerances of reconfigurable multi-element apparatuses for a second category of directional element assembly, e.g., a second type horn antenna assembly. At step 400, position back plate in predetermined configuration, aligning base plate mounting holes with corresponding back plate mounting holes, so that back plate aperture and alignment pins are in a predetermined position to align with desired assembly elements. At step 401 obtain one or more reference measurements. For example, measure horn assembly mounting hole distance using VERSA GAUGE and record the distance measurement. At step 402, dissemble for blast coating. For example, lay assembly flat on horn assembly fixture base with end cap mounting holes down and remove all-thread rods connecting end caps to element stack. Remove end caps while supporting element stack on alignment apparatus for removal of remaining rods. Next, remove remaining rods and carefully disassemble elements from each other afterwards removing all connectors from each element and reinstalling connector mounting screws into each element. At step 403, inspect all components. For example, a user should inspect all elements for damaged to mating surfaces, i.e., inspect element signal surfaces for voids in casting; inspect element roll pins for damage and perpendicular alignment to element. At step 404, reassemble element components. For example, install first element by aligning connector hole onto alignment pin making sure element is seated against back plate of fixture. It may become necessary to install several elements together, and place into position multiple elements at a time (e.g., 3-4 elements) on alignment. Ensure elements are perpendicular to back plate using a framing square as a reference. At step 405, continue the above steps until all elements have been stacked together. At step 406, install element end plate to complete stack. At step 407, secure element stack with ratchet strap to keep assembly together. At step 408, stabilize element stack by placing wooden arc abutting front of element stack with ratchet strap around back plate of fixture, and apply slight pressure with ratchet strap.

At step 409, begin installing all threaded rods, using an alternating process of one rod in front and one rod in back until all rods are installed. For example, with pressure applied to front of horn stack using ratchet strap, ensure each elements is visually seated against the back plate of fixture. Use a feeler gauge on those elements that do not look seated and gently tap unseated elements with a rubber mallet as torque is applied to all threaded rods of the element stack. It will be necessary to continually check that elements remain seated, and remain perpendicular to back plate as threaded rods are tightened. Stop the process and tap those elements that move out of seated position. At step 410, remove element stack from fixture and carefully install spacer boards and finger clamps, which engage to apertures in element stack, applying pressure to finger clamps by turning turn buckle. At step 411, remove all thread rods that are used for mounting end caps. At step 412, install end caps and apply predetermined final torque. At step 413, refer to reference measurement, (made prior to disassembly) and measure outside of element stack to check for a wedge, or out of parallel condition. Compute needed shims required to align one or more out-of-tolerance element(s). At step 414, loosen finger clamps slightly to allow application of even amounts of said shims to each side. At step 415, tighten clamps or straps and repeat measurement, loosening, calculation, and addition of required shims steps until predetermined alignment of said elements are achieved. At step 416, install rods and hardware and torque to predetermined torque using a predetermined pattern. Attempt to obtain even amounts of visible thread on all thread rods as it passes through end cap. At step 417, verify specification measurements and repeat the above steps as required to achieve predetermined dimension. If the second category directional element assembly does not meet predetermined dimensions or tolerances, repeat above steps and add or remove shims as appropriate.

FIGS. 19A and 19B show an exemplary assembly process for aligning and assembling a general type of element, e.g., horn antenna assembly using structures in accordance with an embodiment of the invention. At Step 501, position said back plate in a first orientation so as to align the base plate's mounting holes with corresponding back plate's mounting holes, so that the back plate's elongated aperture adapted to receive the plurality of alignment pins is in position to enable respective alignment and insertion of the pins into the connector holes in the first section of each of the plurality of first directional elements. At step 502, insert the plurality of alignment pins through the back plate elongated aperture. At step 503, install the first and second end cap with end cap mounting bolts to the base plate. At step 504, sequentially position and couple each of the directional elements between the first and second end caps on the base plate. For example, by sequentially placing one side of the directional element on the base plate and the first section of the directional elements on the back plate so as to bring the first section of each directional element in contact with the back plate and aligning the connector hole with a respective alignment pins such that each directional axis of each directional element is approximately parallel to each other and aligned in at least two reference planes. At step 505, install the end caps on either end of a directional element's stack. At step 506, insert the plurality of protrusions extending from the compression or clamping mechanism (e.g., finger bracket clamps) into at least some of the plurality of directional openings on opposing end sections of the element stack of a plurality of directional element stack. At step 507, apply compressive pressure to the element stack using the compression or clamping mechanism (e.g., ratchet straps, scissor jack, finger bracket clamps). At step 508, install the threaded rods into the rod passages and couple the first and second nuts on the threaded rods. At step 509, apply predetermined final torque on installed threaded rods. At step 510, make at least one alignment measurement of the stack and the plurality of first directional elements to determine if one or more out of alignment parameters exists associated with one or more directional axis of one or more of the directional elements exists. For example, one or more out of alignment parameters comprise an out of parallel dimension range parameter associated with the plurality of directional elements. At step 511, if an out of parallel dimension range or parameter condition exists, determine size and number of shims to bring the plurality of first directional elements into a predetermined alignment associated with the first directional axis of each of the directional elements. At step 512, make adjustment of one or more of the directional elements by loosening the nuts and the compressive or clamping structure's pressure on the directional element stack sufficient to enable insertion of the shims into the directional element stack so as to bring the stack into a predetermined alignment. At step 513, tighten the compression or clamping mechanism and the said first and second nuts on the threaded rods, using a predetermined torque pattern. At step 514, repeat making the alignment measurement step to determine if one or more out of alignment parameters exists and repeat steps following the making at least one alignment measurement step until the one or more alignment parameters are not found to exist.

Figure 20:
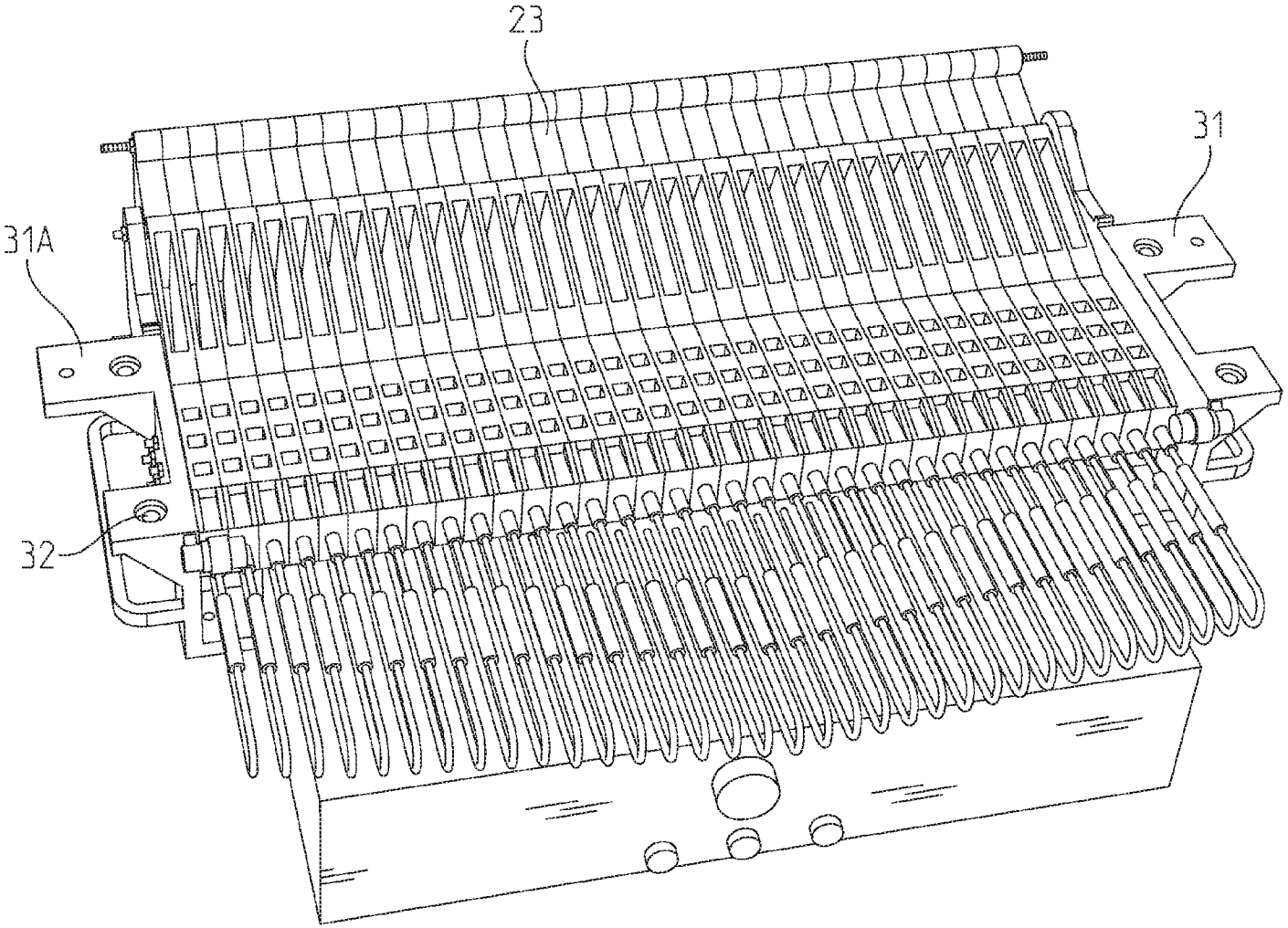
FIG. 20 shows an exemplary depiction of a bottom side of an assembled directional element stack, e.g., horn antenna assembly, in a final configuration ready for installation.

FIG. 20 shows an exemplary depiction of a bottom side of an assembled directional element, e.g., horn antenna assembly, in its final configuration ready for installation. This depiction shows engagements/interrelationships of element stack 23 end cap 31, base plate 17 alignment mounting structure protrusions 41, cylindrical structures 43, 43', and mounting holes 32 in mounting flanges 31A, interrelate as a part of a final assembly. As described above, exemplary end cap 31 is positioned on base plate 17 and used in the assembly of directional elements, e.g., horn antenna elements 1. Once all directional elements are positioned using an embodiment of the invention, another end cap 31 can be attached to an opposite end of element stack 23. Once all final adjustments are complete and entire assembly is torqued to a predetermined specification, the entire assembly can be removed and immediately attached to end state components and installed in a final in-service location.

Figure 21:
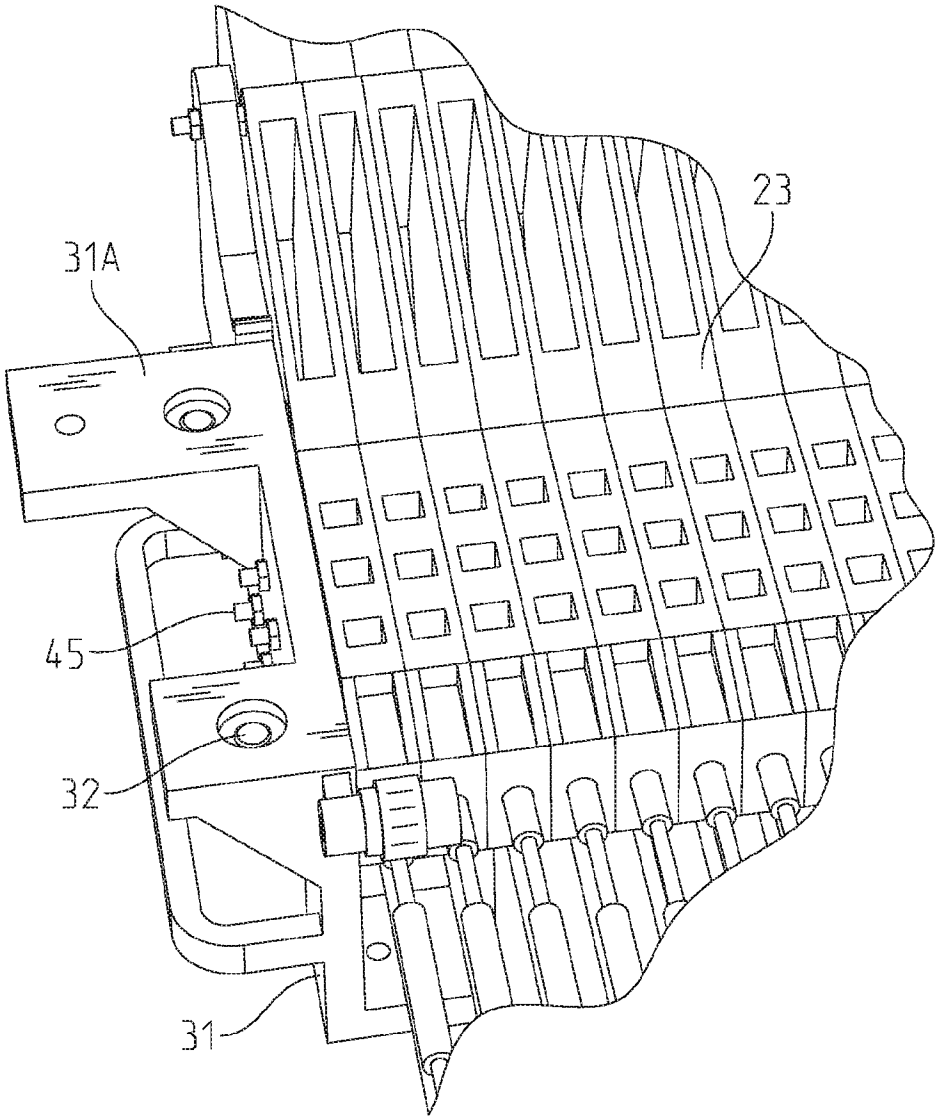
FIG. 21 shows a close up depiction of an end cap used with an exemplary assembled directional element assembly.

FIG. 21 shows a close up depiction of an exemplary end cap 31 showing how end cap 31 attaches to an element stack 23 by use of connecting rods 45.

Figure 22:
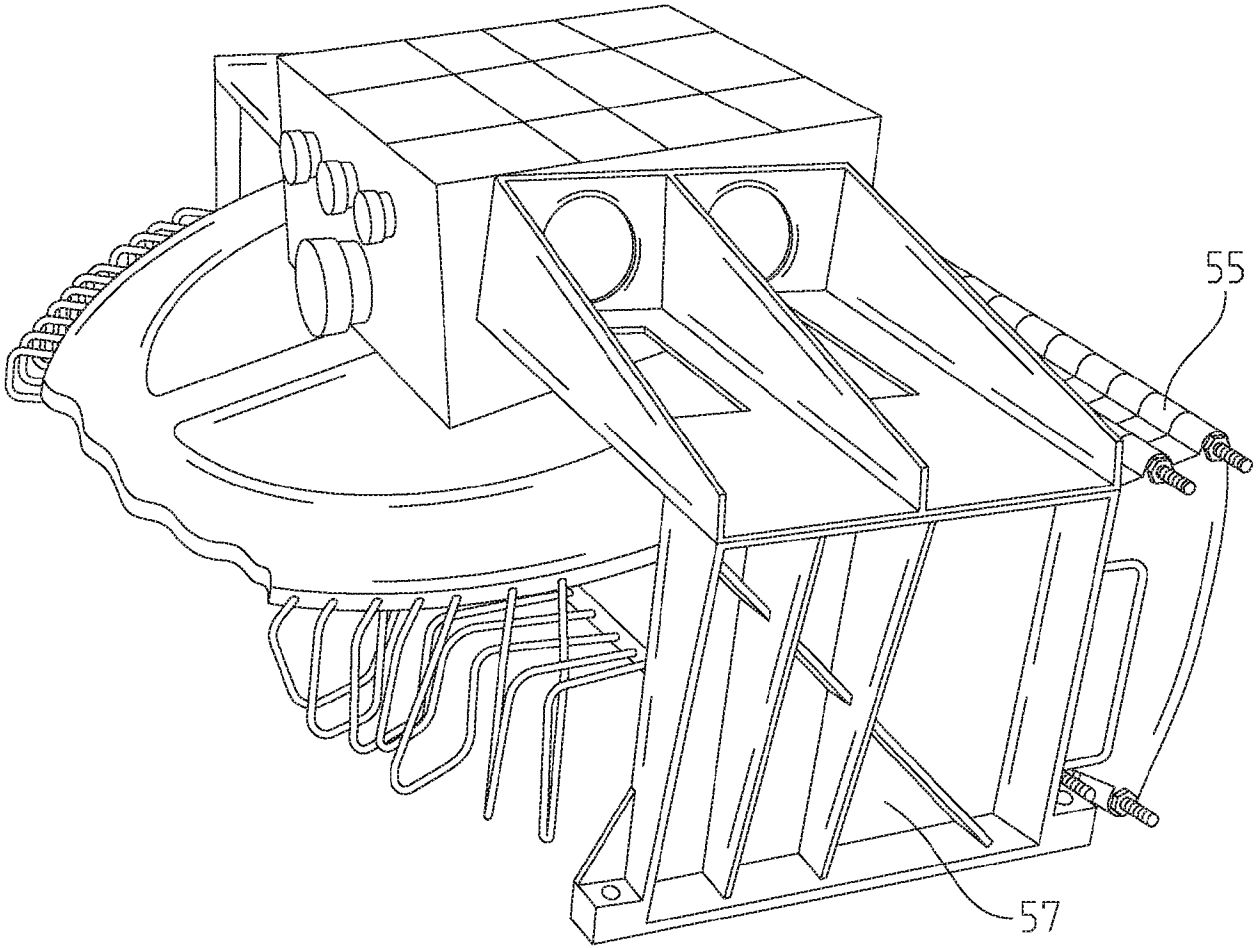
FIG. 22 shows an exemplary depiction of a bottom side of a fully assembled assembly of directional elements, e.g., horn antenna assembly, in a final configuration ready for final installation.

FIG. 22 shows an exemplary embodiment of a bottom side of a fully assembled directional assembly, e.g., horn antenna assembly, in its final configuration ready for final installation. This exemplary embodiment demonstrates how element stack 55 end cap 57, which is adapted to be secured onto base plate 17, is used during an assembly process as a component in a final in-service configuration. End cap 57 can be secured to base plate 17 (see FIG. 9) and element stack 55 can be assembled directly onto a side of end cap 57. Once element stack 55 assembly is complete the entire structure, element stack 55 and end caps 57, can be lifted off of an embodiment of the assembly apparatus can be attached to end state components and is ready for final in-service installation.

Figure 23:
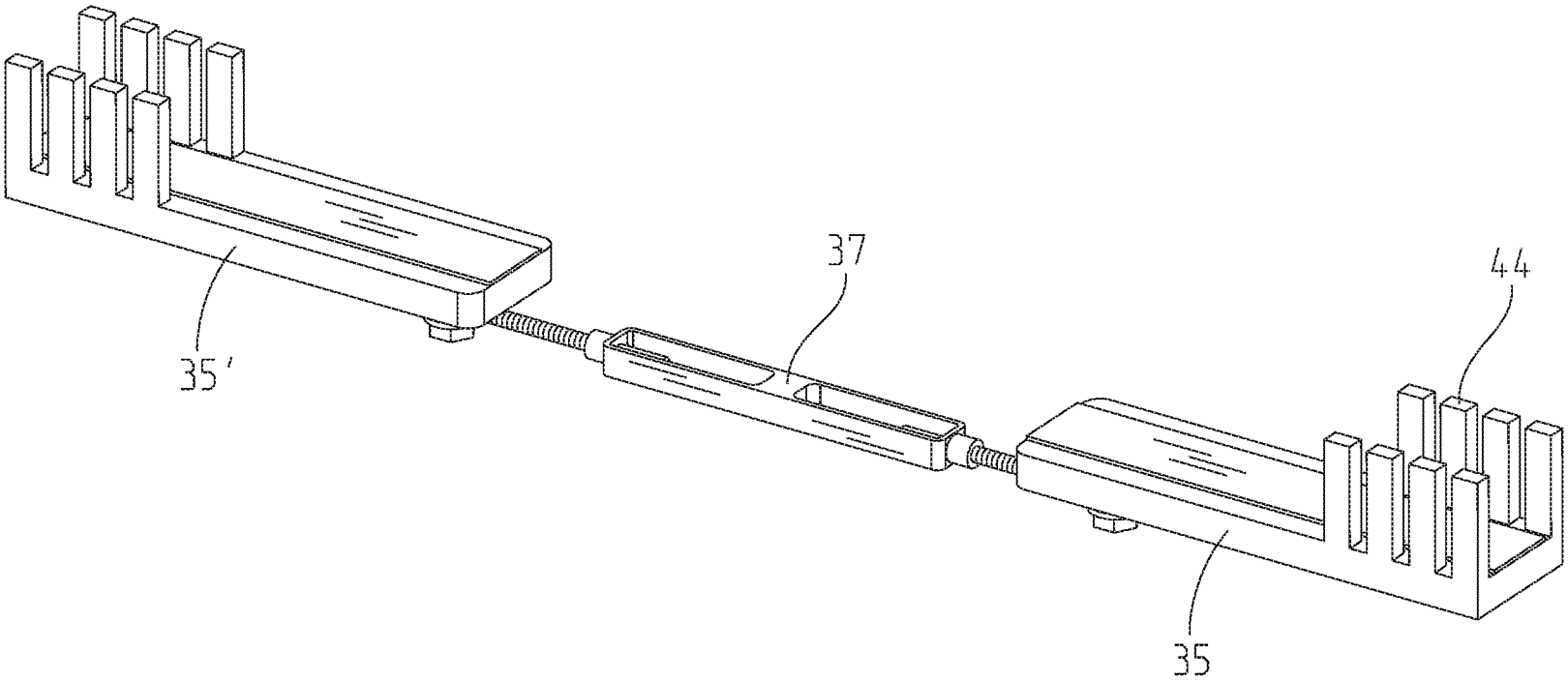
FIG. 23 shows a closer view of finger bracket clamps used to apply compressive force to a stack of directional elements.

FIG. 23 shows a perspective view of an exemplary first finger bracket 35 and second finger bracket 35' comprising a tensioning or compressive structure including a plurality of protrusions 44 adapted to insert into a respective plurality of apertures 46 formed by the antenna elements 1 in the element stack 23 on opposing ends of the element stack 23. An adjustable tensioner 37, e.g., a turnbuckle, is provided and adapted to selectively couple and apply an increasing or decreasing amount of compressive force on the first and second finger brackets 35, 35'. The adjustable tensioner 37 and first and second finger brackets 35, 35' are adapted to selectively and adjustively apply compressive force on the element stack 23 in order to make fine adjustments (e.g., by having an ability to reduce compressive force on the stack to permit adding shims) to the overall dimensions of element stack 23 in order to conform to predetermined specifications, e.g., on alignment and orientation.

The invention claimed is:

1. Apparatus for maintaining tolerances of a reconfigurable multi-element apparatuses usable for different assembly processes comprising:

a base plate;

a back plate adapted to be coupled to said base plate in a plurality of predetermined angle relationships wherein said back plate comprises a lateral aperture adapted to receive a plurality of alignment pins adapted to engage with alignment locations of multiple element assembly items such that said element items are held in a predetermined orientation with respect to said back plate and said base plate;

a first and second alignment mounting structure coupled with said base plate, wherein said base plate and said first and second alignment mounting structure is further adapted to couple to mounting or end cap parts disposed on opposing ends of said multiple element assembly items which hold said items together and further are formed with mounting flanges and apertures; and an adjustable compression or clamping mechanism which maintains/releases pressure on said multiple element assembly items against said back plate so as to enable measurements of tolerances of said multiple element assembly items and re-alignment of said elements with respect to each other;

wherein said back plate is adapted to hold the alignment pins in a first location when said back plate is in a first orientation for a one type of multiple element assembly items and hold said alignment pins in a second location when said back plate is in a second orientation for a different type of multiple element assembly items.

2. The apparatus of claim 1, wherein said adjustable compression or clamping mechanisms comprises an adjustable strap run laterally across said multiple element assembly items and around a back side of said back plate opposite of a side facing said multiple element assembly items.

3. The apparatus of claim 1, wherein said adjustable compression or clamping mechanism comprises an expansion mechanism such as a scissor jack having a screw actuator that leverages against a leverage point on said base plate on one side and against a side of said multiple element assembly items on a side of said multiple element assembly items opposing an assembly item side in contact with said back plate.

4. The apparatus of claim 1, further comprising:

a first and second finger bracket comprising a structure including a plurality of protrusions adapted to insert into a respective plurality of apertures formed in said multiple element assembly items on opposing ends of the assembly;

an adjustable tensioner adapted to couple said first and second finger brackets;

wherein said adjustable tensioner and first and second finger brackets are adapted to selectively apply compressive force on said multiple element assembly items.

* * * * *